US009969169B2

(12) United States Patent
Moriwaki et al.

(10) Patent No.: US 9,969,169 B2
(45) Date of Patent: May 15, 2018

(54) LIQUID DISCHARGER AND LIQUID DISCHARGER FAILURE DETECTION METHOD

(71) Applicants: Yuta Moriwaki, Kanagawa (JP); Takahiko Sugiura, Kanagawa (JP)

(72) Inventors: Yuta Moriwaki, Kanagawa (JP); Takahiko Sugiura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/293,451

(22) Filed: Oct. 14, 2016

(65) Prior Publication Data

US 2017/0106655 A1 Apr. 20, 2017

(30) Foreign Application Priority Data

Oct. 15, 2015 (JP) ..... 2015-204116

(51) Int. Cl.
*B41J 2/165* (2006.01)
*B41J 2/045* (2006.01)

(52) U.S. Cl.
CPC ..... *B41J 2/16505* (2013.01); *B41J 2/0451* (2013.01); *B41J 2/04586* (2013.01); *B41J 2/16508* (2013.01); *B41J 2/16511* (2013.01)

(58) Field of Classification Search
CPC ..... B41J 2/0451; B41J 2/16508; B41J 29/38; B41J 2/16511; B41J 2/165; B41J 2/04586; B41J 2/16505
USPC ..... 347/19, 22, 29, 32
See application file for complete search history.

(56) References Cited

U.S. PATENT DOCUMENTS 5,953,024 A * 9/1999 Lee ..... B41J 2/16508 347/23
2009/0315941 A1* 12/2009 Kojima ..... B41J 2/1652 347/22
2013/0194346 A1 8/2013 Moriwaki
2014/0009531 A1 1/2014 Kaneko et al.
2014/0063121 A1 3/2014 Moriwaki et al.
2014/0152745 A1 6/2014 Park
2014/0265106 A1 9/2014 Saitoh et al.
2015/0077478 A1 3/2015 Kawabata et al.
2016/0129693 A1 5/2016 Moriwaki et al.

FOREIGN PATENT DOCUMENTS

JP 2012-061680 3/2012
JP 2013-111801 6/2013

* cited by examiner

*Primary Examiner* — Jannelle M Lebron
(74) *Attorney, Agent, or Firm* — Oblon, McClelland, Maier & Neustadt, L.L.P.

(57) ABSTRACT

A liquid discharger comprises a head including a nozzle face and a nozzle that discharges liquid droplets, the nozzle formed on the nozzle face, a carriage that mounts the moves the head in a train scanning direction, a driver that moves the carriage in the main scanning direction, a cap that contacts and covers the nozzle face, a cap mover that moves the cap between a capping position, in which the cap contacts the nozzle face, and an evacuation position, in which the cap is separated from the nozzle face, and processing circuitry configured to judge whether a capping failure has occurred based on a driving force that is measured when the carriage starts to move in the main scanning direction after the cap mover moves the cap to the capping position.

6 Claims, 18 Drawing Sheets

LIQUID DISCHARGER AND LIQUID DISCHARGER FAILURE DETECTION METHOD

CROSS-REFERENCE TO RELATED APPLICATIONS

The present application claims priority to Japanese patent application 2015-204116, filed in Japan on Oct. 15, 2015, the entire contents of which are incorporated by reference herein.

BACKGROUND

The present invention relates to a liquid discharger, and in particular relates to a liquid discharger including a head to discharge liquid droplets and a cap to cover a nozzle face of the head.

Many devices, such as a printer, a facsimile machine, a copier, a plotter, and a multifunction apparatus, include a liquid discharger. For example, an inkjet recording apparatus may use a liquid discharging head that discharges liquid on a sheet while conveying the sheet to the head.

An inkjet recording apparatus may include a maintenance mechanism that maintains and recovers a discharge ability of a liquid discharge head. The maintenance mechanism has a cap to cap the liquid discharge head and a cap mover to vertically move the cap. While the inkjet recording apparatus is in a waiting mode, a carriage, which mounts the liquid discharge head and movable in a main scanning direction, moves to a position facing the maintenance mechanism.

Devices may judges whether a cap normally covers a nozzle. A movement regulation part regulates the movement of the carriage by catching the carriage when the cap reaches a capping position to cover the nozzle. If the cap does not move upward because of the trouble of the carriage mover, the movement regulation part does not catch the carriage, so the carriage is movable without restriction.

That is, the inkjet recording apparatus judges that the cap normally covers the nozzles if the cap is moved to the capping position by the cap mover and the movement regulation part catches the carriage, and also whether the carriage is movable without restriction. However, in order to judge the capping condition, the above inkjet recording apparatus requires the movement regulation part, which increases the complexity and the production cost of the apparatus.

BRIEF SUMMARY

The present application provides a liquid discharger capable of detecting a failure of capping a head by a cap. The liquid discharger according to the present application comprises a head a carriage, a driver, a cap, a cap mover and processing circuitry. The head includes a nozzle face al that discharges liquid droplets, the nozzle formed on the nozzle face. The carriage mounts the head and moves the head in a main scanning direction. The driver moves the carriage in, the main scanning direction. The cap contacts and covers the nozzle face. The cap mover moves the cap between a capping position, in which the cap contacts the nozzle face, and an evacuation position, in which the cap is separated from the nozzle face. The processing circuitry is configured to judge whether a capping failure has occurred based on a driving force that is measured when the carriage starts to move in the main scanning direction after the cap mover moves the cap to the capping position.

The liquid discharger may further comprise a carriage detector that detects a movement of the carriage, wherein the processing circuitry judges that the capping failure has occurred when the measured driving force is below a threshold value sand the carriage detector detects the movement of the carriage. The cap may contact the nozzle face to seal the nozzle.

The liquid discharger may further comprise a plurality of heads including the head, and a plurality of caps including the cap, each cap of the plurality of caps being provided for a different head of the plurality of heads herein the carriage mounts the plurality of heads, and the cap mover moves the plurality of caps. The processing circuitry judges whether the failure of capping has occurred based on a difference between a first driving force and a second driving force, the first driving force is, measured when the carriage starts to move in the main scanning direction after the cap mover moves the plurality of caps to a first capping position where n number of heads (n is equal to or greater than 2) of the plurality of heads face the plurality of caps, and the second driving force is measured when the carriage starts to move in the main scanning direction after the cap mover moves the plurality of caps to a second capping position where n−1 number of heads of plurality of heads face the plurality of caps.

The liquid discharger may further comprise a plurality of heads including the head, and a plurality of caps including the cap, each cap of the plurality of caps configured to cap a different respective head of the plurality of heads, wherein the carriage mounts the plurality of heads, and the cap mover moves one cap of the plurality of caps between the capping position and the evacuation position independently. The processing circuitry judges whether a failure of fixing the head on the carriage has occurred based on a plurality of detected drive force, and the plurality of detected drive force is measured for the plurality of the heads when the carriage starts to move in the main scanning direction after the cap mover moves the one cap to the capping position.

The processing circuitry may control the driver to move the cap to the capping position and to gradually increase the driving force of the driver.

The present application further provides a failure detection method for a liquid discharger including a head that includes a nozzle face and a nozzle that discharges droplets, a carriage that mounts the head and moves in a main scanning direction, a driver that moves the carriage in the main scanning direction, as cap that contacts and covers the nozzle face, and a cap mover. The method comprises detecting when the cap mover moves to a capping position, in which the cap contacts the nozzle face, the cap mover configured to move a cap between the capping position and an evacuation position in which the cap is separated from the nozzle face; measuring a driving force of the carriage when the carriage starts to move in tin scanning direction after the cap mover moves the cap to the capping position; comparing, by processing circuitry, the driving force to a predetermined threshold value; determining, by the processing circuitry, that a capping failure has occurred when the driving force exceeds the threshold value; and determining, by the processing circuitry, that the capping failure has not occurred when the driving force does trot exceed the threshold value.

The present application further provides a controller for a liquid discharger including a head that includes a nozzle face and a nozzle that discharges droplets, a carriage that mounts the head and moves in a main scanning direction, a driver that moves the carriage in the main scanning direction, a cap that contacts and covers the nozzle face, and a cap mover. The controller comprises processing circuitry configured to detect when the cap mover moves to a capping position, in which the cap contacts the nozzle face, the cap mover configured to move a cap between the capping position and an evacuation position in which the cap is separated from the nozzle face; measure a driving force of the carriage when the carriage starts to move in the main scanning direction after the cap mover moves the cap to the capping position; compare the driving force to a predetermined threshold value; determine that a capping failure has occurred when the driving force exceeds the threshold value; and determine that the capping failure has not occurred when the driving force does not exceed the threshold value.

These and other objects, features, and advantages of the present disclosure will become more readily apparent upon consideration of the following description and the accompanying drawings.

BRIEF DESCRIPTION OF THE DRAWINGS

The accompanying drawings are included to provide further understanding of the present application, and are incorporated in and constitute a part of this specification. The drawings, together with the specification, serve to explain the principles of the present application.

DETAILED DESCRIPTION

In the following discussion, exemplary implementations are described in detail with reference to the accompanying drawings so as to facilitate the understanding of the disclosure. However, the disclosure of this patent specification is not intended to be limited to the specific terminology so selected, and it is to be understood that each specific element includes all technical equivalents that operate in a similar manner and achieve a similar result.

In the present disclosure, "sheet" is not limited to the paper material, but also includes an OHP sheet, fabrics, boards, etc., on which liquid droplets or other liquid may be deposited. The term "sheet" is a collective term for a recorded medium, recording medium, recording sheet, and the like.

The term "liquid discharger" may refer to a device for forming an image by impacting liquid droplets to media such as paper, thread, fiber, fabric, leather, metals, plastics, glass, wood, ceramics and the like. "Image formation" is not limited, to forming images with letters or figures having meaning to the medium, but also forming images without meaning such as patterns to the medium (and impacting the droplets to the medium).

The term "liquid" is not limited to so-called ink, but refer to liquids such as recording liquid, fixing liquid, and aqueous fluid to be used for image formation, which further includes, for example, DNA samples, registration and pattern materials and resins. The term "liquid" may further include liquid binder used to bind powders for a binder-jet type 3D printer.

Further, a liquid discharger in accordance with the present disclosure may include any of a serial-type liquid discharger and a line-type liquid discharger.

An image is not limited to a plane two-dimensional image, but also includes a three-dimensional image, and an image formed three-dimensionally from a 3D figure.

Figure 1:
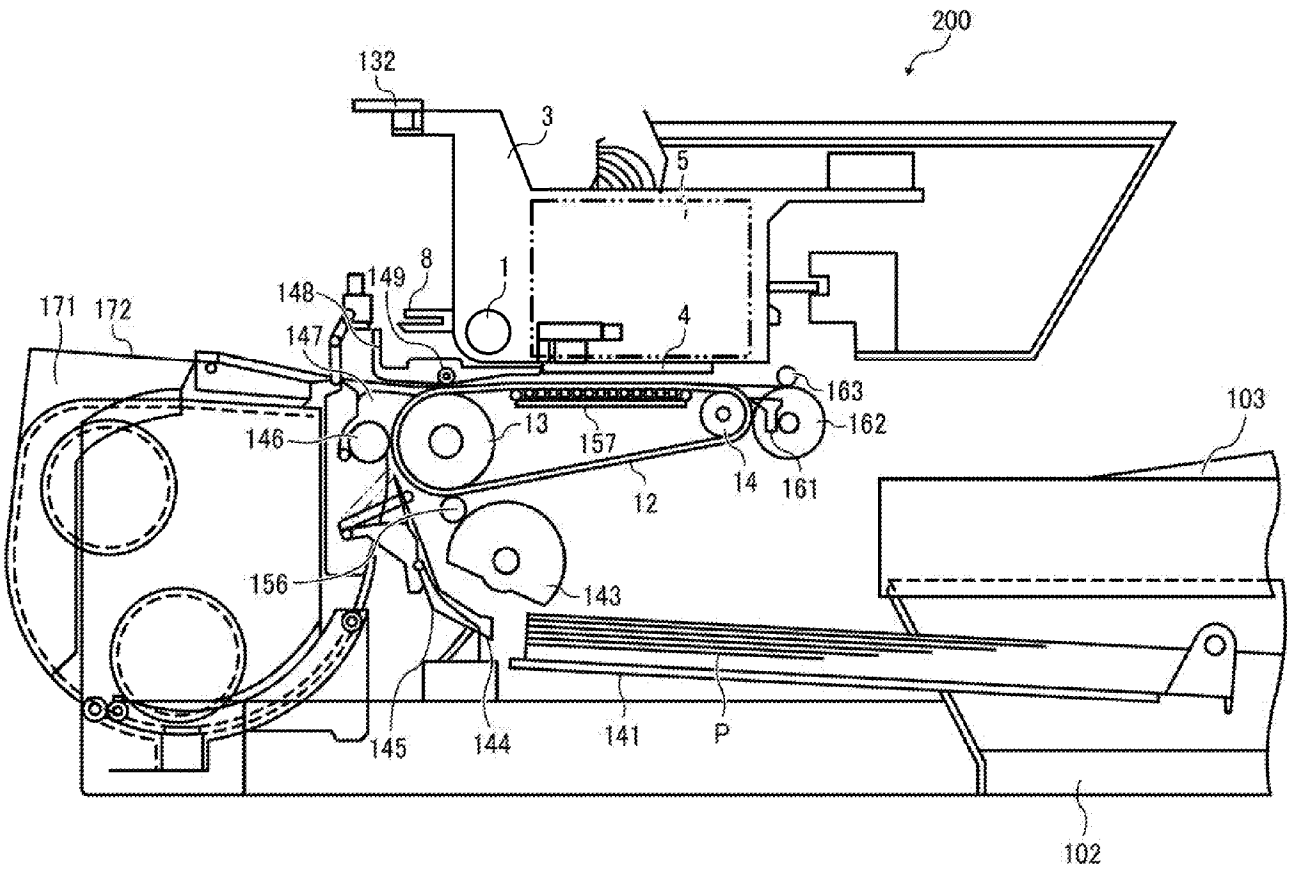
FIG. 1 is a side view illustrating an overall configuration of a liquid discharger.
Figure 2:
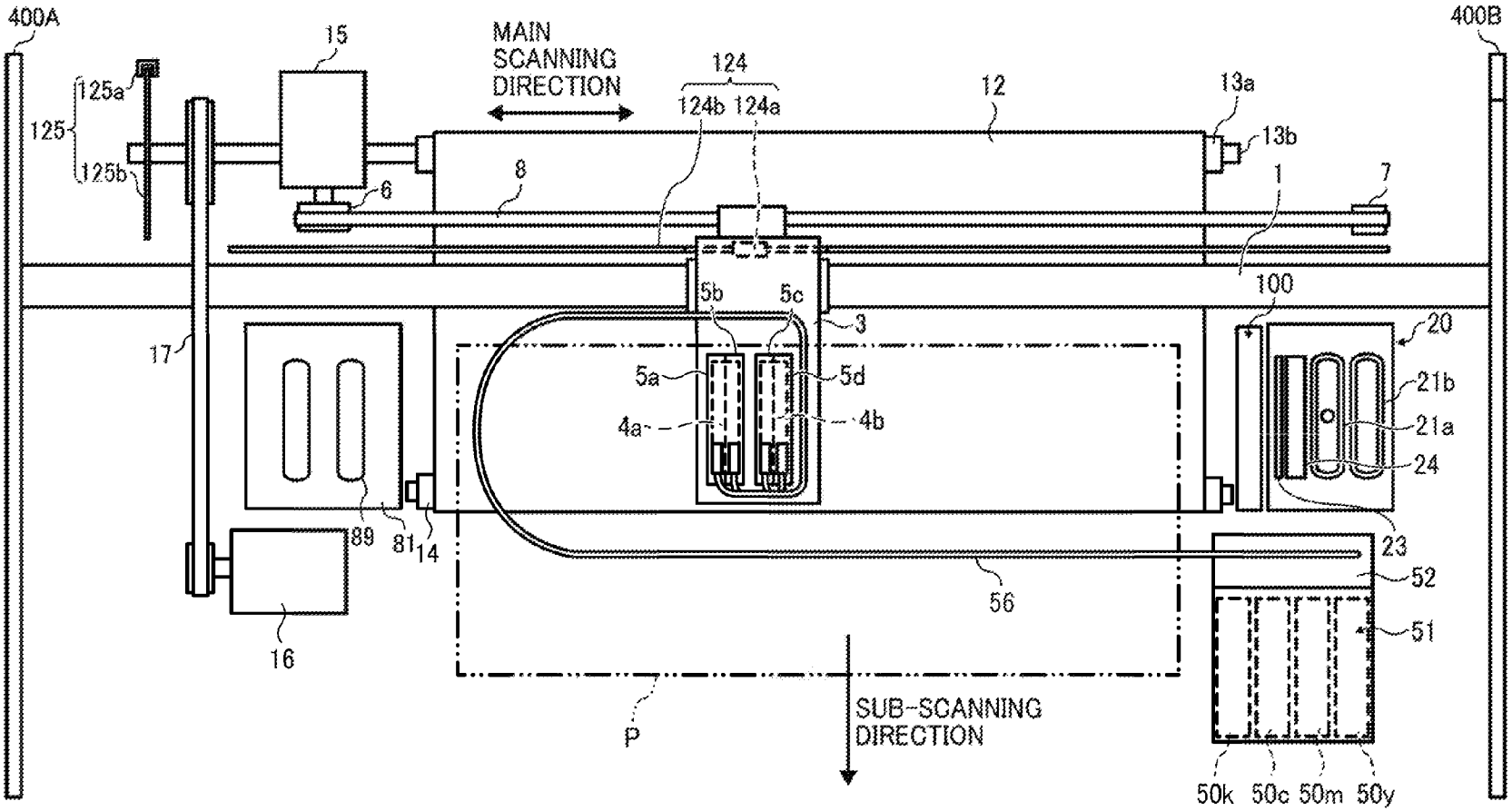
FIG. 2 is an explanatory plan view of a main part of the liquid discharger of FIG. 1.
Figure 3:
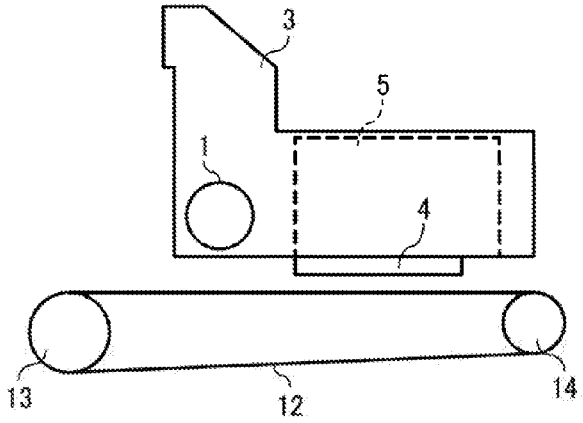
FIG. 3 is a side view around a head of the liquid discharger.

Discussion of the liquid discharger will begin with reference to FIGS. 1-3. In particular FIG. 1 illustrates a side view of an overall configuration of liquid discharger 200, while FIG. 2 is an explanatory plan view of a main part of the liquid discharger 200 of FIG. 1. FIG. 3 is a side view of a carriage 3, a head 4, and a conveyer 12 of liquid discharger 200.

Liquid discharger 200 is a serial-type inkjet recording apparatus, including a guide rod 1 and side plates 400A and 400B disposed at lateral sides of the liquid discharger 200 to support the guide rod 1. The guide rod 1 is horizontally mounted on the lateral side plates 400A and 400B. This liquid discharger 200 includes a carriage 3 held by the guide rod 1 and slidably movable in a main scanning direction shown by arrow in FIG. 2. The carriage 3 moves and scans in the main scanning direction by as main scanning motor 15 via a timing belt 8. The carriage 3 mounts two beads 4A and 4B to discharge liquid droplets, which may be referred to collectively as the head 4. A conveyer 12 conveys medium to a position facing the head 4 so that the liquid discharged from the head 4 is landed on the medium. The conveyer 12 is driven by a drive roller 13 and a driven roller 14.

Figure 4:
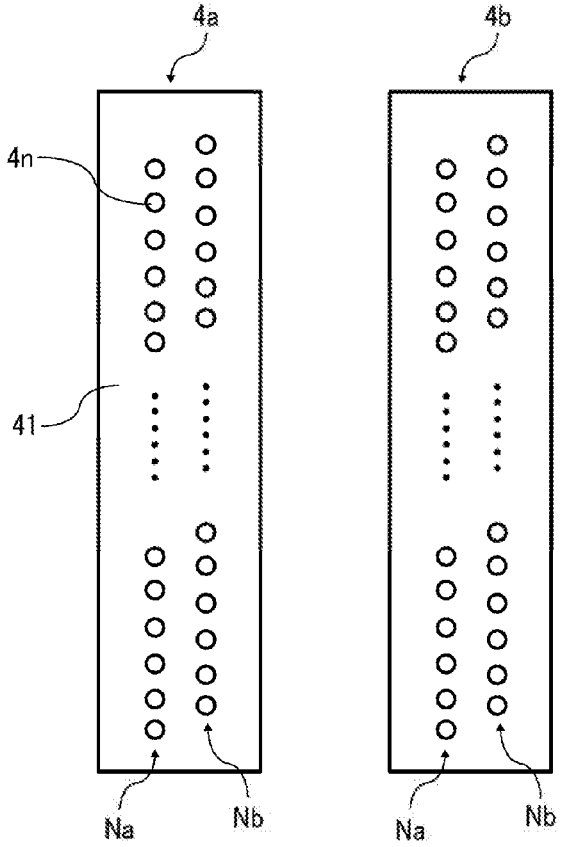
FIG. 4 is a schematic view of the nozzle face of the head.

FIG. 4 is a schematic view of the nozzle face of the head. As shown in FIG. 4, each of the heads 4A and 4B includes two nozzle arrays Na and Nb formed of a plurality of nozzles 4*n* arranged in a sub-scanning direction perpendicular to the main scanning direction. Each of the nozzles 4*n* of the nozzle arrays Na and Nb are arranged to be at a different position in the nozzle array direction. In other words, the nozzle arrays Na and Nb are arranged to be staggered in the nozzle array direction.

Here, the liquid discharger 200 has two heads 4*a* and 4*b* that discharge 4 colors of liquid droplets. However, the liquid discharger 200 may have 4 heads for discharging liquid of each color. Any type of a head, for example a head using piezoelectric actuator having piezoelectric element or a head using thermal actuator having electric-neat transfer element such as heat element employing phase change of liquid by film boiling, can be used as a head 4.

The nozzle array Na of the head 4*a* discharges liquid droplets of black ink (K), while the nozzle array Nb of the head 4*a* discharges liquid droplets of cyan ink (C). Also, the nozzle array Na of the head 4*b* discharges liquid droplets of magenta ink (M), while the nozzle array Nb of the head 4*b* discharges liquid droplets of yellow ink (Y).

The carriage 3 has four head tanks 5*a*, 5*b*, 5*c*, and 5*d*, which correspond to each of the two nozzle arrays Na and Nb of each of the heads 4*a* and 4*b* as shown in FIGS. 2 and 4. Hereinafter, the four head tanks 5*a*, 5*b*, 5*c*, and 5*d* will be collectively referred as head tanks 5 when it is not necessary to distinguish between the head tanks. The liquid discharger 200 has a cartridge holder 51 that is in an apparatus body. Main tanks (liquid cartridges) 50*k*, 50*c*, 50*m*, and 50*y* of each color of the liquid are mounted on the cartridge holder 51, and are exchangeable by insertion into or removal from the cartridge holder 51.

The cartridge holder 51 has supply pump 52 that sends liquid for each color to each of corresponding head tanks 5*a*, 5*b*, 5*c*, and 5*d*, respectively, from the liquid cartridges 50 through supply tubes (liquid supply path) 56 for each color.

The liquid discharger 200 has a sheet feeding portion that conveys sheets P that are piled on a sheet piling portion (pressure plate) 141 of a sheet feed tray 102. The sheet feeding portion includes a sheet feed roller 143 to separate and feed sheets P from the sheet piling portion 141 one by one and a separation pad 144 facing the sheet feed roller 143 and formed of a material having a high friction coefficient. The separation pad 144 is pressed against the sheet feed roller 143.

Then, in order to send the sheet P fed from the sheet feed portion to the lower side of the head 4, a guide member 145 to guide the sheet P, a counter roller 146, a conveyance guide member 147, a pressure member 148 including an end press roller 149, and a conveyance belt 12.

The conveyance belt 12 electrostatically attracts the fed sheet P and conveys the sheet at a position facing the print heads 4. The conveyance belt 12 is an endless belt stretching over a conveyance roller 13 and a tension roller 14, and is configured to rotate in a belt conveyance direction (i.e., a sub-scanning direction). Charging roller 156 is a charging means to charge a surface of the conveyance belt 12.

The charging roller 156 is disposed in contact with the surface layer of the conveyance belt 12 and is driven to rotate by the rotation of the conveyance belt 12. The conveyance belt 12 is caused to rotate in a belt conveyance direction by the rotation of the conveyance roller 13 driven by a sub-scanning motor 16 via the timing belt 17, as shown in FIG. 2.

Further, as shown in FIG. 1, as a sheet ejection portion to eject the sheet P recorded by the heads 4, a separation claw 161 to separate a sheet P from the conveyance belt 12, a sheet discharge roller 162, and a spur 163 being a sheet discharge roller are provided. A sheet discharge tray 103 is provided underneath the sheet discharge roller 162.

A duplex unit 171 is provided detachably at a backside of the apparatus body. This duplex unit 171 pulls in a sheet P which has been returned by a reverse rotation of the conveyance belt 12, reverses the sheet P, and feeds the reversed sheet P again in as portion between the counter roller 146 and the conveyance belt 12. An upper surface of the duplex unit 171 is used as a manual tray 172.

Furthermore, as shown in FIG. 2, a maintenance mechanism 20 including a recovery means to maintain the nozzles 4*n* of the heads 4 in good condition is provided at a non-print area at one side in the scanning direction of the carriage 3. The maintenance mechanism 20 includes: caps 21*a* and 21*b*, a wiper blade 23, and a first idle discharge receiver 24. Each of the caps 21*a* and 21*b* caps the nozzle surfaces 41 of the heads 4*a* and 4*b* to prevent evaporation of water and to keep the moisture inside the heads 4. Hereinafter, caps 21*a* and 21*b* may be referred to as cap 21 if it is not necessary to distinguish between the caps.

Figure 7:
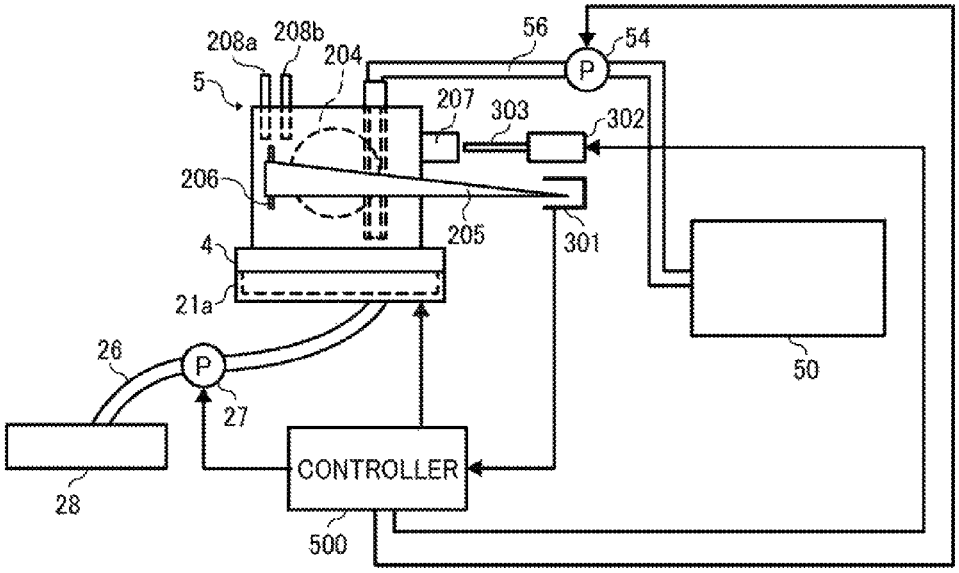
FIG. 7 is side view of a liquid supply path from a main tank to a head tank and a suction pump that sucks liquid inside the bead tank.

One of the caps 21*a* and 21*b* is a suction cap 21*a* connected to a suction pump 27 and the other is a moisture keeping cap 21*b*, which is not connected to the suction pump 27. The wiper blade 23 is a blade member to wipe the nozzle surfaces 41. The first idle discharge receiver 24 receives droplets which are not used for the recording when performing an idle discharge operation in order to discharge agglomerated recording liquid. Further, as shown in FIG. 7 (to be discussed later), the suction cap 21*a* is connected to a waste tank 28 via suction pump 16. The waste tank 28 contains waste liquid generated by the maintenance operation, and the waste tank 28 is replace-ably attached to the apparatus body.

While the suction cap 21*a* covers the nozzle surface 41 of the heads 4, the suction 27 is driven to suck the waste liquid from the nozzles 4*n* of the nozzle surface 41 of the head 4 and to supply the waste liquid to the waste tank 28 through the discharge tube 26. Therefore, the suction cap 21*a* removes the agglomerated recording liquid attached around the nozzle 4*n* and nozzle surface 41.

In this way, the suction cap 21*a* keeps the moisture inside the nozzle 4*n* of the heads 4 and sucks liquid from the nozzle of the heads 41. On the other hand, the moisture keeping cap 21*b* only keeps the moisture inside the nozzle 4*n* of the heads 4.

The liquid discharger 200 has a discharge detector 100 that detects whether the liquid is discharged from the nozzle 4*n* of the heads 4, as shown in FIG. 2. The liquid discharger 200 is provided outside the discharge region located between the conveyance belt 12 and the maintenance mechanism 20, and is located at the position to be able to face the heads 4.

For example, the discharge detector 100 has an electrode plate to detect voltage change generated when the liquid discharged from the heads 4 lands on the electrode plate. The discharge detector 100 may have a light emitter such as a laser diode and a light receiver such as a photo sensor to detect whether the liquid discharged from the heads 4 cuts off the laser tight emitted from the light emitter.

An encoder scale 124*b* is disposed between the side plates 400A and 400B along the main scanning direction of the carriage 3, and an encoder sensor 124*a* to read the pattern formed on the encoder scale 124*b* is disposed on the carriage 33. The encoder scale 124*b* and the encoder sensor 124*a* form a linear encoder 124. The position of the carriage 3 in the main scanning direction (or the carriage position) and displacement amount thereof can be detected from a detection signal of the linear encoder sensor 124*a*. The encoder sensor 12*a* may have a light emitter such as a laser diode and a light receiver such as a photo sensor to detect the laser light that pass through the encoder scale 124*b* to read the pattern formed on the encoder scale 124*b*.

A code wheel 125*b* is mounted on the axis 13*b* of the roller 13*a*. An encoder sensor 125*a* has a photo sensor to read the pattern formed around the on the periphery of the code wheel 125*b*. The encoder sensor 125*a* and the code wheel 125*b* may be part of a rotary encoder 125 (a sub scanning encoder) to detect an amount of movement and a movement position of the conveyance belt 12.

Further, a second idle discharge receiver 81 is disposed at a non-print area at an opposite side of the maintenance mechanism 20 in the scanning direction of the carriage 3 in order to receive droplets of recording liquid when performing an idle discharge operation in which recording liquid, that has an increased viscosity during recording and does not contribute to the recording, is discharged. The second idle discharge receiver 81 includes openings 89 aligned in the nozzle array direction of the heads 4.

In the liquid discharger 200, the sheets P are separated and fed one by one from the sheet feed tray 102, the sheet P fed upward in a substantially vertical direction is guided by the guide member 245, and is conveyed while being sandwiched between the conveyance belt 12 and the counter roller 146. The leading edge of the sheet P is then guided by the conveyance guide member 147 and is pressed against the conveyance belt 12 by the end press roller 149 to change the conveyance direction by 90 degrees.

Then, an alternate voltage, which is an alternate repetition of positive and negative voltages, is applied, to the charge roller 156. Thus, the conveyance belt 12 is charged in an alternate charge pattern, in which a positive charge and a negative charge is alternately applied with predetermined widths in a strip shape in the sub-scanning direction which is the direction of rotation of the conveyance belt 12.

When the sheet P is fed on the alternately charged conveyance belt 12, the sheet P is attracted to the conveyance belt 12 and is conveyed in the sub-scanning direction by the rotational movement of the conveyance belt 12. The sheet P is attracted to the conveyance belt 12 by the electrostatic force applied on the conveyance belt 12. However, the sheet P may be attracted to the conveyance belt 12 by the suction means for sucking the sheet P to the conveyance belt 12.

When the machine is in a stand-by condition/state, the carriage 3 is moved to a home position opposite the maintenance mechanism 20, and each of the suction cap 21*a* and the moisture keeping cap 21*b* contact the nozzle faces 41 of each of the heads 4*a* and 4*b*, respectively, to seal and keep the moisture inside the head 4.

Figure 8:
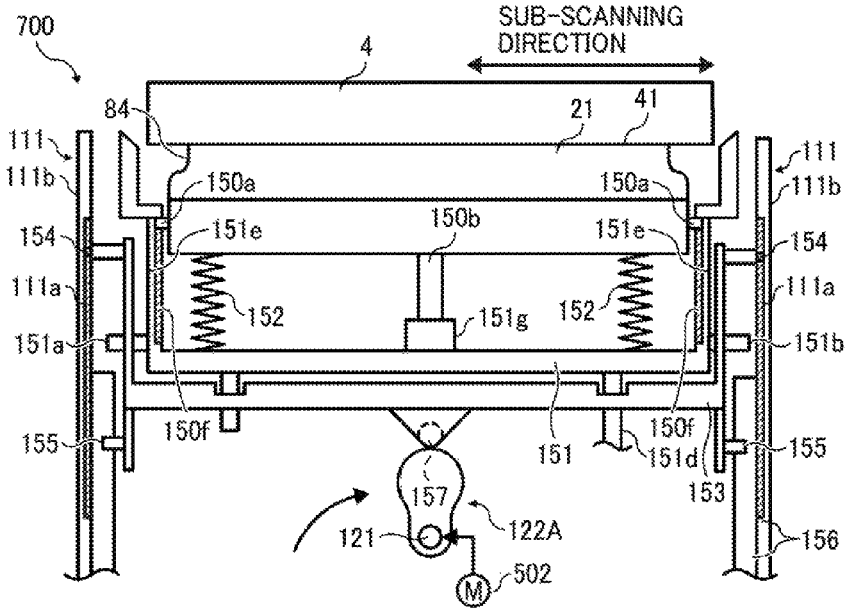
FIG. 8 is a side view of a cap mover.

Then, when the image signal is input to the liquid charger 200, the controller 500 (shown in FIG. 7) moves each of the caps 21*a* and 21*b* down by driving a maintenance motor 502 and rotating a cam shaft 121 and a cap cam 122*a*, as shown in FIG. 8. FIG. 7 is side view of a liquid supply path from a main tank to a head tank and a suction pump that sucks liquid inside the head tank, while FIG. 8 is a side view of a cap mover. The controller 500 drives the main scanning motor 15 and starts the scanning movement of the carriage 3 in the main scanning direction.

When the heads 4*a* or 4*b* moves at the first idle discharge receiver 24, the controller 500 stops the movement of the carriage 3, and the heads 4*a* or 4*b* discharge few numbers of liquid droplets to the first idle discharge receiver 24. When the idle discharge of each of the heads 4*a* and 4*b* are finished, the controller 500 starts again the scanning movement of the carriage 3 in the main scanning direction.

The controller 500 drives the heads 4 in response to image signals while moving the carriage 3 in the main scanning direction so as to discharge liquid droplets onto the predetermined portion of the stopped sheet P to record a predetermined range of the image on the sheet P in the sub-scanning direction. After the predetermined range of the image is recorded on the sheet P, the controller 500 moves the carriage 3 at the second idle discharge receiver 81, and the heads 4*a* and 4*b* discharge liquid droplets to the second idle discharge receiver 81 as necessary.

Then, the controller 500 drives the conveyance belt 12 for a predetermined time to move the sheet P for a predetermined distance in the sub-scanning direction and stops the movement of the conveyance belt 12 to perform recording of next lines in response to image signals while moving the carriage 3 in the main scanning direction. By repeating the process explained above for a predetermined times, a desired image is printed on the sheet P. When recording an image on the sheet P while repeating a conveyance and stop conveyance of the sheet P, the sheep is attracted to the conveyance belt 12 by electrostatic force. Therefore, it is possible to stably convey the sheet P to the position facing to the heads 4.

Upon reception of a recording end signal or a signal indicating that a rear end of the sheet P has reached the recording area, the recording operation is terminated and the sheet P is discharged to the sheet discharge tray 103. Furthermore, when the image forming process has ended, the controller 500 moves the carriage 3 to a home position where the maintenance mechanism 20 is located. Then, the controller 500 moves each of the caps 21*a* and 21*b* upward to contact the nozzle face 41 of the heads 4*a* and 4*b* to keep the moisture inside the nozzle 4*n* of the heads 4*a* and 4*b*.

Further, liquid discharger 200 may have a selection means such as a selection button for selecting a cleaning mode which is previously installed in the liquid discharger 200. For example, if a user checks the recorded image on the sheet P and finds a degraded image on the sheet P, the user may select and perform the cleaning mode to clean the liquid discharger 200.

When the cleaning mode is performed, the controller 500 moves the carriage 3 to the position above the maintenance mechanism 20 so that the head 4*a* faces the suction cap 21*a*. Next, the controller 500 moves the suction cap 21*a* upward until the suction cap 21*a* contacts the nozzle face 41 of the head 4*a*, and drives the suction pump 27 (shown in FIG. 7) to suck liquid together with air, dust, and solidified liquid from the nozzles 4*n* of the head 4*a*.

After completing the suction operation of the suction cap 21*a*, the controller 500 moves the suction cap 21*a* downward and moves the wiper blade 23 upward at the same time. When the wiper blade 23 contacts the nozzle face 41, the controller 500 moves the carriage 3. By this carriage movement, the wiper blade 23 wipes the nozzle face 41 and removes the liquid droplets adhered to the nozzle face 41.

After removal of the liquid droplets from the nozzle face 41 by the wiper blade 23, the controller moves the wiper blade 23 downward. Then, the controller 500 moves the carriage 3 to the position above the first idle discharge receiver 24 to perform idle discharge to the first idle discharge receiver 24. The same processes explained above are performed for the head 4*b* so that it is possible to clean the liquid droplets attached to the nozzle face 41 of the heads 4*a* and 4*b* to prevent a discharge failure of the heads 4*a* and 4*b*.

Figure 6:
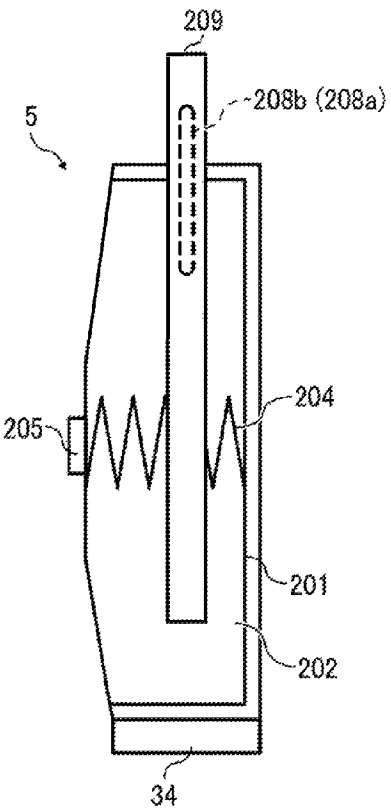
FIG. 6 is a front view of the head tank.
Figure 5:
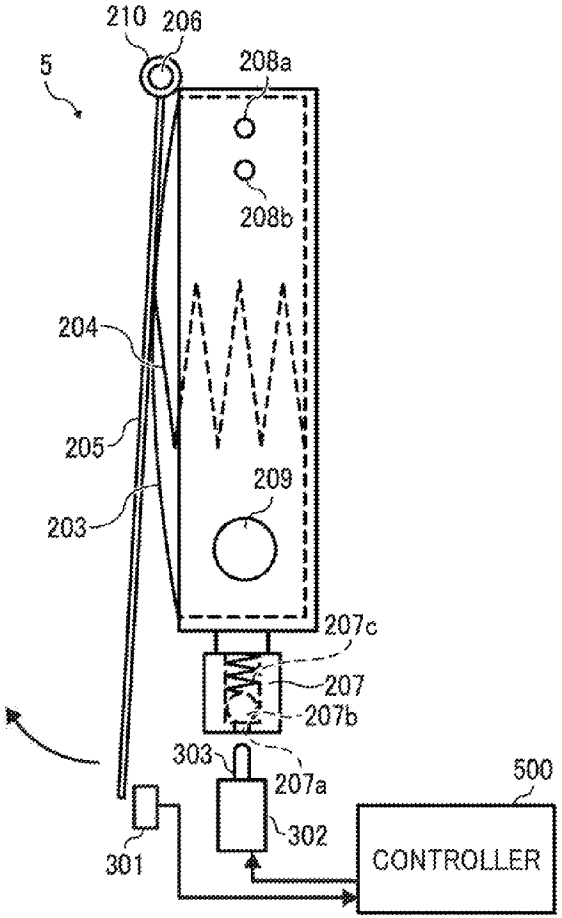
FIG. 5 is a plan view of a head tank.

Next, an example of the head tank 5 will now be described with reference to FIGS. 5 and 6. FIG. 5 is a schematic plan view of the head tank 5 corresponding to one nozzle array and FIG. 6 is a schematic front view of the head tank 5.

Each head tank 5 includes a tank case 201 forming liquid container 202 and an opening. The opening of the tank case 201 is sealed with at flexible film member 203. A spring 204 as an elastic member disposed inside the tank case 201 constantly pushes the film member 203 outward by a restoring force of the spring 204. With this structure, because the film 203 of the tank case 201 is pressed outward by the spring 204, if the remaining amount of the liquid inside the liquid container 202 of the tank case 201 is reduced, a negative pressure is generated.

A displacing, member 205 (hereinafter, also referred to as a feeler) disposed outside the tank case 201 and formed of feeler is swingably supported by a support shall 206 at its one end thereof and is pressed against the tank case 201 by the spring 210. The displacing member 205 is press-contacted against the film member 203 by the spring 210 and displaces in conjunction with a movement of the film member 203.

Remaining amount of the liquid and negative pressure inside the head tank 5 can be obtained by detecting the displacing member 205 by a second sensor 301 disposed on the apparatus body, as shown in FIG. 7.

A supply port 209 through which the liquid is supplied from liquid cartridge 50 is disposed at an upper part of the tank case 201 and the supply port 209 is connected to the supply tube 56. In addition, an air release unit 207 to expose an interior of the head tank 5 to the atmosphere is disposed at a side of the tank case 201. The air release unit 207 includes an air release path 207*a* communicating to an interior of the head tank 5, a valve 207*b* configured to open or close the air release path 207*a*, and a spring 207*c* to press the valve 207*b* to close the air release path 207*a*.

An air release solenoid 302 is disposed at the apparatus body. The air release solenoid 302 has a press member 303 to presses and opens the valve 207*b*. When the press member 303 presses and opens the valve 207*b* against the pushing force of spring 207*c*, the air inside the head tank 5 is allowed to be released to the atmosphere, i.e., in a state communicating to the environmental atmosphere.

A pair of electrode pins 208*a* and 208*b* detect a level of the liquid surface inside the head tank 5. Because the liquid has a conductivity when the liquid surface reaches the electrode pins 208*a* and 208*b*, electric current flows between the electrode pins 208*a* and 208*b*, and a resistance value of each electrode pin changes. With this structure, it can be detected whether the level of the liquid inside the head tank 5 has reduced to a predetermined level or below. That is, it can be detected whether the air amount inside the head tank 5 has increased to a predetermined amount.

Next, a liquid supply path to the head tank 5 and discharge system for discharging liquid inside the head tank 5 in the present image forming apparatus will now be described with reference to FIG. 7.

A fluid conveyance pump 54 conveys the liquid from the liquid cartridge 50 ("main tank", hereinafter) to the head tank 5 via the supply tube 56. The fluid conveyance pump 54 is a reversible pump formed of a tube pump and performs both an operation to supply liquid from the liquid cartridge 50 to the head tank 5 and an operation to return liquid from the head tank 5 to the liquid cartridge 50.

A feeler sensor 301 is disposed at the apparatus body to detect the displacing member 205. The controller 500 controls the liquid supply operation from the liquid cartridge 50 to the head tank 5 based on the detection results obtained from the feeler sensor 301.

The driving of the fluid conveyance pump 54, air release solenoid 302, and suction pump 27, and the liquid supplying operation according to the present disclosure are controlled by controller 500.

Next, an exemplary liquid supply operation will be explained.

Usually, the controller 500 controls the pressure inside the head tank 5 to be negative pressure. To perform liquid supply operation, the controller 500 drives the air release solenoid 302 to release the air inside the head tank 5 to the atmosphere. By this release, the film 203 deforms outward, and the level of the liquid surface inside the head tank 5 decreases. Further, the displacing member 205 displaces outward, as shown by the arrow in FIG. 5, by the outward deformation of the film 203, so the feeler sensor 301 does not detect the displacing member 205.

Next, the controller 500 drives the fluid conveyance pump 54 to convey the liquid from the liquid cartridge 50 to the head tank 5 via the supply tube 56 so that the level of the liquid surface inside the head tank 5 increases. Then, the controller 500 stops the supply of liquid to the head tank 5 and close the air release unit 207 when the electrode pins 208*a* and 208*b* detects the liquid surface.

Then, the controller 500 drives the fluid conveyance pump 54 to return the liquid from the head tank 5 to the liquid cartridge 50 so that the film 203 deforms inward and negative pressure is generated inside the head tank 5. The displacing member 205 displaces toward the feeler sensor 301 by the inward deformation of the film 203, and the feeler sensor 301 detects the displacing member 205.

The controller 500 stops the fluid conveyance pump 54 to urn liquid from the head tank 5 to the liquid cartridge 50. Thus, the controller 500 can control the pressure inside the head tank 5 to be within a predetermined range of negative pressure. Because the change of the liquid level inside the head tank 5 by the liquid returning operation from the head tank 5 to the liquid cartridge 50 is small, the condition that the electrode pins 208*a* and 208*b* detects the liquid surface can be maintained.

By this functionality, the feeler sensor (detects the displacing member 205 when the displacing member 205 displaces outward with the deformation of the film 203, and the feeler sensor 301 does not detect the displacing member 205 when the displacing tuber 205 displaces inward with the deformation of the film 203.

Next, an example of a cap mover 700 will be explained with reference to FIG. 8, which illustrates a side view of cap mover 700. Cap mover 700 moves the cap 21 between a capping position where the cap 21 covers the nozzle face 41 of the head 4 and an evacuation position where the cap 21 is separated from the head 5.

The cap mover 700 has a cap holder 112A. The cap holder 112A has a holder 151 and two springs 152. The holder 151 holds the cap 21 such that the cap 21 can move vertically upward and downward. Two springs 152 are mourned between the bottom surface of the holder 151 and a bottom part of the cap 21. The springs 152 push both end parts of the cap 21 in the sub-scanning direction (the direction along the nozzle array Na and Nb of the head 4) upward.

Further, the cap mover 700 has a slider 153 that holds the holder 151 and supported by frame 111 to be movable in the vertical direction. The cap 21 has guide pins 150*a* disposed in both ends of the cap 21. Each of these guide pins 150*a* are inserted into the e grooves 150*f* formed on the both of the side walls 151*e* of the holder 151, respectively. Thus, the guide pins 150*a* can moves along the guide grooves 150*f*.

Further, the cap mover 700 has a guide axis 150*b* at the central part of the bottom of the cap 21. The guide axis 150*b* is inserted into a guide axis holder 150*g* of the holder 151 such that the guide axis 150*b* can move vertically inside the guide axis holder 150*g*. The slider 153 has two guide pins 154 and 155 on both ends in the sub-scanning direction as shown in FIG. 8. The frame 111 has side walls 111*b* and guide grooves 111*a*, which is formed on both of the side walls 111*b*. The guide grooves 111*a* extend along the side walls 11*b* in a vertical direction.

Figure 9:
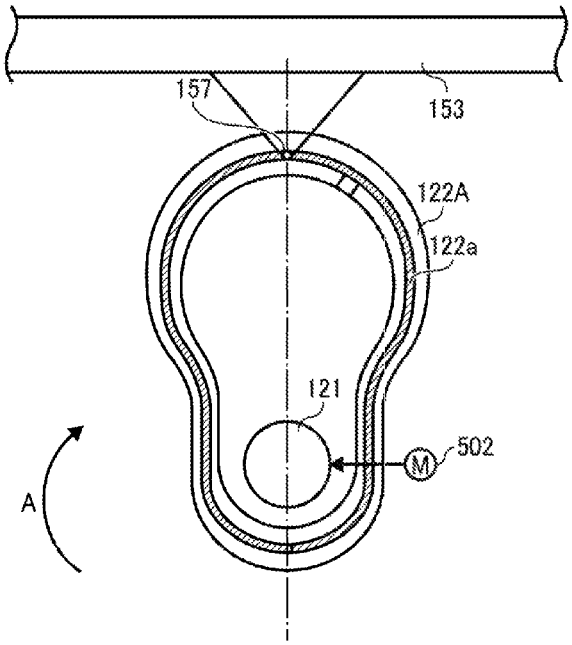
FIG. 9 is a schematic view of a cap cam.

The guide pins 154 and 155 are inserted into the guide grooves 111*a* of the side walls 111*b* such that the guide pins 154 and 155 move along the guide grooves 111*a*. The cap mover 700 has a cam pin 157 disposed at a central part of the bottom surface of the slider 153. The cap mover has a cap cam 122A that rotates to move the slider vertically. The cap cam 122A has a cam groove 122A formed around the periphery of the cap cam 122A. The cam pin 157 fits in the cam groove 122A as shown in FIG. 9, which illustrates a schematic view of cap cam 122*a*.

The cap mover 700 has a cam axis 121 connected to a maintenance motor 502. The cap cam 122A is fixed to the cam axis 121. The controller 500 drives the maintenance motor 502 and rotates the cam axis 121 of the cap mover 700. The cap cam 122A rotates with the rotation of the cam axis 121, and the slider 153 moves vertically by the rotation of the cap cam 122A. By the vertical movement of the slider 153, the holder 151 held by the slider 153 and the cap 21 held by the holder 151 are also moves vertically, which is a direction perpendicular to the nozzle face 41.

The cap 21 has an elastic part 84 made of such as rubber on top of the cap 21. The elastic part 84 of the cap 21 contacts the nozzle face 41 of the head 4.

Sometimes, the cap 21 does not contact nozzle face 41 because of an abrasion of the elastic part 84 for a long time use. Further, sometimes the cap 21 does not move upward so that the cap 21 does not contact nozzle face 41 even if driving the maintenance motor 502 for a predetermined time because of malfunction of cap mover 700. In these cases, the cap 21 cannot normally cap and seal the nozzle face 41 so that the cap 21 cannot keep the moisture inside the nozzle 4*n* of the head 4.

If the nozzle face 41 has not been normally capped and sealed by the cap 21 for long, time, the liquid inside the nozzle 4*n* will be dried and stick to the nozzle 4*a* to plug the nozzle 4*n*. Therefore, the liquid discharger 200 cannot discharge liquid from the nozzle 4*n*. Then, it is not possible to restore the discharge ability of the head 4 by the suction operation of the suction cap 21*a* and the suction pump 27. Detection of this capping failure is an objective of the present application.

The liquid discharger 200 of the present application is configured to detect a capping failure of the cap 21 to the nozzle face 41 of the head 4 and inform user that the capping failure has occurred at an appropriate timing. Thus, the user can repair the liquid discharger 200 by exchanging the cap 12 or informing a service person about capping failure. As a result, it is possible to prevent the bead 4 to be uncapped for a long time, which cause the malfunction of the head 4.

Figure 10:
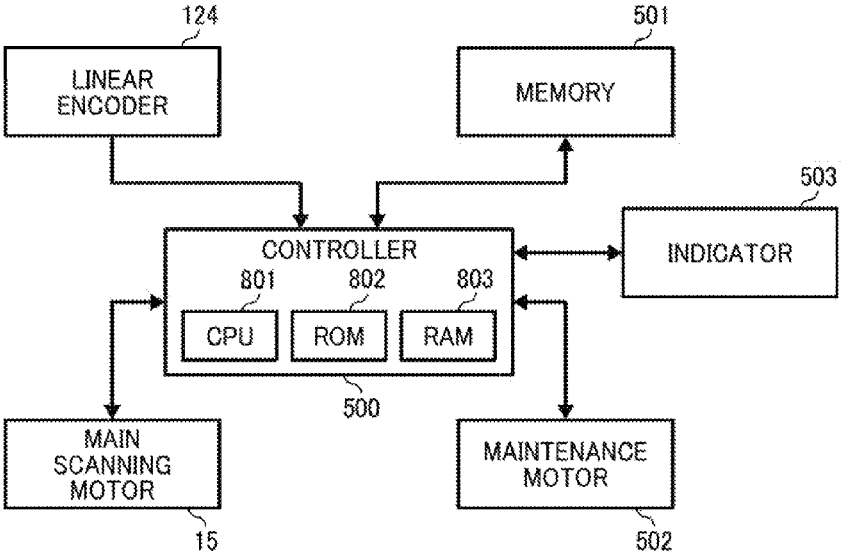
FIG. 10 is a block diagram illustrating a flow of control of a capping failure detecting operation.

FIG. 10 is a control block diagram illustrating a part of an electrical circuit of a capping failure detecting control operation. As shown in FIG. 10, the controller 500 includes a CPU 801, a read-only memory (ROM) 802, and a random access memory (RAM) 803. In an exemplary implementation, the functionality of controller 500 is performed by the processing circuitry. In particular, CPU 801, in conjunction with any of ROM 802 and RAM 803, may be a general or specific-purpose processor, a digital signal processor (PSP), an ASIC, a field programmable gate array (FPGA) or other programmable logic device (PLD), a discrete gate or transistor logic, discrete hardware components or any other combination for executing functions to realize logic blocks. CPU 801 may include modules, parts, circuits and/or integrated circuits, all of which may be referred to as processing circuitry and/or control circuitry. The processing circuitry may include a general-purpose processor, and the processing circuitry may include an number of processors, controllers, micro-controllers or state machines. The processing circuitry can also be a combination of computer equipment, such as a combination of a DSP and a micro-processor, a combination of plural micro-processors, or a combination of a DSP and plural micro-processors.

The linear encoder 124, the main scanning motor 15, the maintenance motor 502, a memory 501, and an indicator 503 are connected to the controller 500. The CPU 801 may be configured to perform various programs. The read-only memory (ROM) 802 stores various fixed data. The random access memory (RAM) 803 temporarily stores image data.

Moreover, executable instructions performed by the processing circuitry may be stored in a non-transitory computer-readable medium. The non-transitory computer-readable medium can be any real medium that can be accessible by the processing circuitry. Such a non-transitory computer-readable medium may include RAM 20, ROM 30, HDD 40, an EEPROM, or other static/dynamic memory or media.

CPU 801 controls a whole of the image processing device 1. RAM 803 is a volatile recording media available to read or write data fast, is used for a work area of CPU 801. ROM 802 is a non-volatile read-only memory in which is stored programs as a firmware.

The linear encoder 124 detects a movement of the carriage 3. The main scanning motor 15 drives the carriage 3 to move in the main scanning direction. The maintenance motor 502 drives the cap mover 700 to move caps 21 vertically. The memory 501 stores data of a drive voltage threshold Value Vsn and an encoder count threshold value Ss. The drive voltage threshold Value Vsn is obtained from an experiment beforehand and is used for capping failure judgment. The encoder count threshold value Ss is used for judging a movement of the carriage 3. The ROM 802 stores a control program of the capping failure judgment. The CPU 801 reads the control program of the capping failure judgment from the ROM 802 and performs the read control program. Thus, the controller 500 may function as a judging means.

Figure 11:
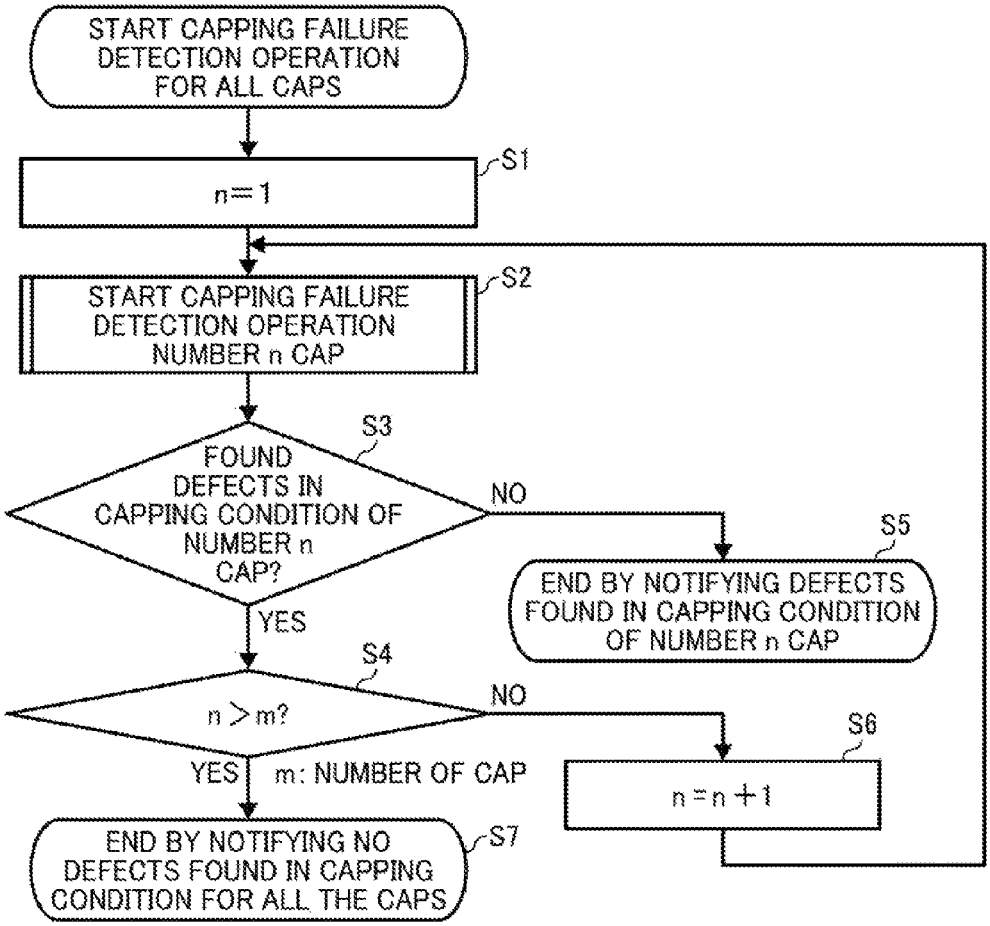
FIG. 11 is a flow chart illustrating a flow of control of a capping failure detecting operation.
Figure 12:
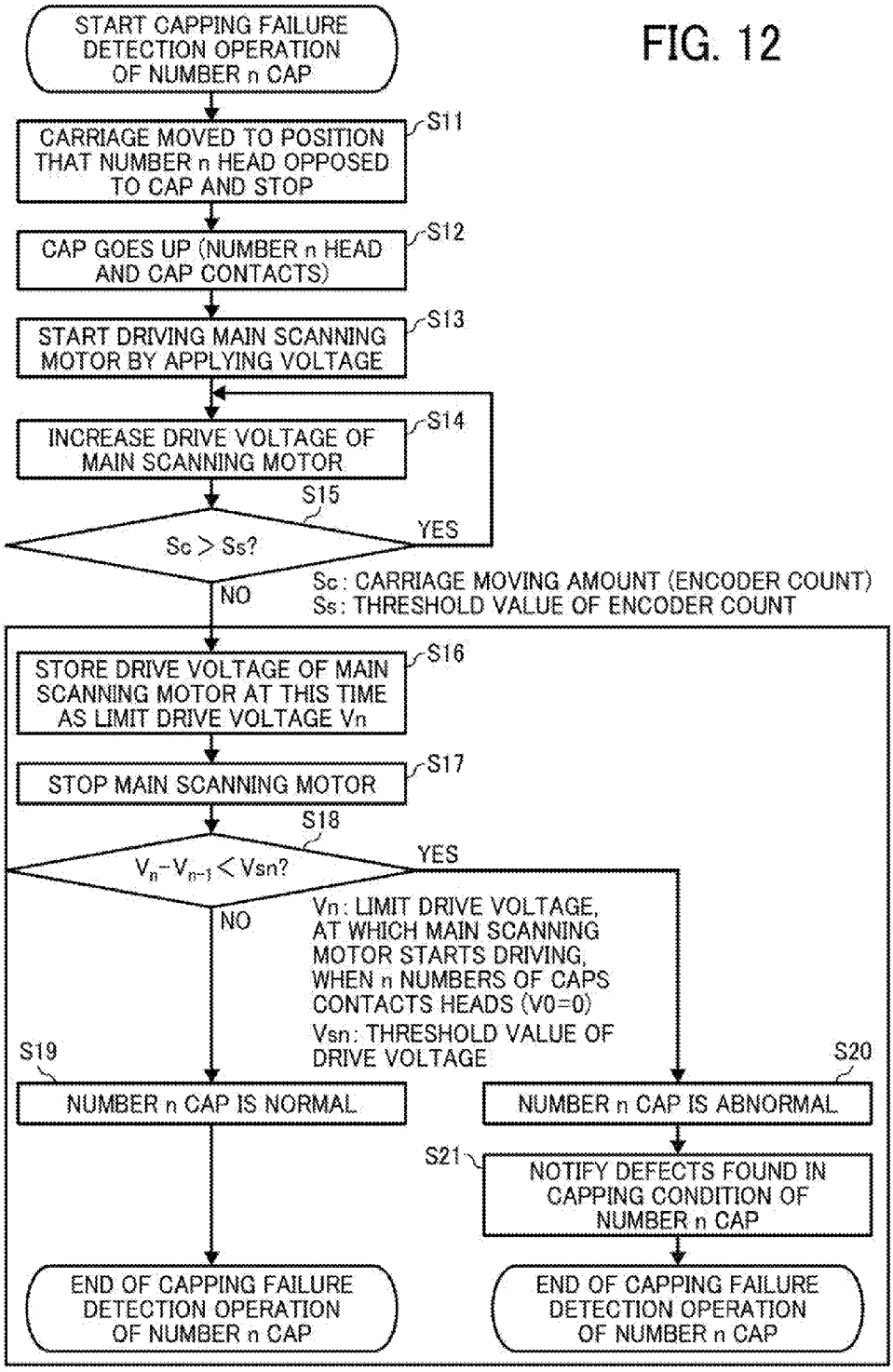
FIG. 12 is as flow chart illustrating a capping failure detecting operation of a cap.

FIG. 11 is a flow chart illustrating a flow of control of a capping failure detecting operation performed by controller 500. FIG. 12 is a flow chart illustrating a detailed capping failure detecting operation of a cap.

The capping failure detection is performed by processing circuitry of controller 500 after the completion of the liquid discharge operation, such as image forming operation, and before the capping of the heads 4*a* and 4*b* by the caps 21*a* and 21*b*, for example. First, the controller 500 performs the capping failure detection of the first cap, which is the suction cap 21*a*, counted from the direction from the conveyance belt 12 to the side plate 400B in FIG. 2 (S1 and S2). That is, in S2 of FIG. 11, the controller 500 performs the capping failure detection operation, as illustrated in S11-S21 of FIG. 12.

As shown in FIG. 12 and FIG. 2, when the capping failure detection is started, the controller 500 moves the carriage 3 and stops at the position where n numbers of the heads 4 face the caps 21 (S11). For example, when n=1, the carriage 3 is stopped at the position where the head 4*b* faces the suction cap 21*a*.

Next, the controller 500 moves the caps 21 upward so that the caps 21 contact the nozzle faces 41 of n numbers of the heads 4 (S12), in the present disclosure, when n=1, the cap 21*a* is moved upward to contact the nozzle face 41 of the head 4*b*. Next, the controller 500 starts driving the main scanning motor 15 and gradually increases the voltage applied to the main scanning motor 15 to gradually increase the driving force of the main scanning motor 15 (S14 and S15).

The controller 500 monitors the output from the encoder sensor 124*a* of the linear encoder 124 and determines whether the carriage 3 has moved according to the output from the encoder sensor 124*a* (S15). Specifically, the controller 500 reads out the encoder count threshold value Ss from the memory 501 and counts the output signal of the encoder sensor 124*a* and determines whether a carriage movement amount Sc, which is the count value of the output signal of the encoder sensor 124*a*, is equal to or greater than the encoder count threshold value Ss. The controller 500 gradually increase the driving three of the main scanning motor 15 until the carriage movement amount Sc is equal to or greater than the encoder count threshold value Ss (YES in S15).

Actually, even if the caps 21 normally contact and cap the nozzle face 4 of the heads 4, the carriage 3 slightly moves in the main scanning direction when the main scanning motor 15 is driven because of the elastic deformation of the elastic part 84 disposed at the edge of the caps 21. The encoder count threshold value Ss described above is an amount of movement of the carriage 3, which is calculated from a count value of the encoder sensor 124*a*, by the elastic deformation of the elastic part 84 when the main scanning motor 15 is driven and when the caps 21 normally contact and cap the nozzle face 41 of the heads 4. The encoder count threshold value Ss may be predetermined.

In S15, the controller 500 judges that the carriage 3 starts to move when the carriage movement amount Sc become equal to or greater than the encoder count threshold value Ss (NO of S15). This is the time when a drive force of the main scanning motor 15 exceeds a static friction force between the caps 21 and the nozzle face 41 of the heads 4.

The controller 500 stores the drive voltage of the main scanning motor 15, which is detected when the drive force of the main scanning motor 15 exceeds a static friction force, as a limit drive voltage Vn in the memory 501 (S16). When n=1, the limit drive voltage Vn stored in the memory 501. Further, the controller 500 stops driving the main scanning motor 15 when the controller 500 judges that the carriage 3 starts to move (S17).

Next, the controller 500 reads out a limit drive voltage Vn, a limit drive voltage Vn−1, and a drive voltage threshold value Vsn. The limit drive voltage Vn−1 is measured at the time of the capping failure judgment of the number n−1 cap, which is performed before the capping failure judgment of the number n cap. Then, the controller 500 calculates a value by deducting the limit drive voltage Vn−1, which is measured at the time of number n−1 capping failure detection, from the limit drive voltage Vn, which is measured at the time of number n capping failure detection. Next, the controller 500 judges whether the calculated value Vn−Vn−1 is smaller than the drive voltage threshold value Vsn (S18).

When n=1, the controller 500 treats the limit drive voltage Vn as V1=V0=0, and thus the controller 500 checks whether the measured limit drive voltage V1 is smaller than the drive voltage threshold value Vsn.

The drive voltage threshold value Vsn described above may be predetermined. Controller 500 determines the drive voltage threshold value Vsn by measuring the drive voltage of the main scanning motor 15 when the carriage 3 starts to move in the condition where the head 4 is normally capped by one cap 21.

When all of n numbers of the caps 21 normally contact and cap the nozzle face 41 of the heads 4, each of the caps 21 contact the nozzle face 41 with a predetermined contact pressure. When this occurs, a static friction force between each of the caps 21 and the heads 4 become a predetermined value F, and the drive force of the main scanning motor 15 necessary for moving the carriage 3 against the static friction force between each of the caps 21 and the heads 4 becomes F×n.

On the other hand, if all of n−1 numbers of caps 21 normally contact and cap the nozzle face 41 of the heads 4, the drive force of the main scanning motor 15 necessary for moving the carriage 3 becomes F×(n−1). When an electric current sent to the main scanning motor 15 is constant, the driving force is a direct proportion of the drive voltage. Therefore, it is possible to obtain the static friction force between the number n cap 21 and the corresponding head 4 by deducting the limit drive voltage Vn−1, which is measured at the time of number n−1 capping failure detection, from the limit drive voltage Vn, which is measured at the time of number n capping failure detection.

When the limit drive voltage (Vn−Vn−1) is smaller than the drive voltage threshold value Vsn (YES in S18), the controller 500 judges nit number n cap 21 does n normally contact the nozzle face 41 because of the reduced contact pressure between the number n cap 21 and the nozzle face 41 of the corresponding head 4, and thus the static friction force between the number n cap 21 and the nozzle face 41 is below the predetermined static friction force F. As a result, the number a cap 21 cannot normally seal the head 4 and keep the moisture inside the nozzle 4*n*. Therefore, the controller 500 judges that the number n cap 21 is abnormal (S20), and notifies the user that the number n cap 21 does not normally cap the head 4 on the indicator 503 (S21).

On the other hand, when the limit drive voltage (Vn−Vn−1) is equal to or greater than the drive voltage threshold value Vsn (NO in S18), the controller 500 judges that number n cap 21 normally contact the nozzle face 41 with the predetermined contact pressure (S19).

In this way, when the capping failure detection of number n cap 21 is finished, and controller 500 judges that there are defects in a capping condition of the number n cap 21 as shown in FIG. 11 (YES in S3), the controller 500 ends the capping failure detection for all the caps 21 (S5).

On the other hand, when the capping failure detection of number n cap 21 is finished, and controller 500 judges that there are no defects found in capping condition of the number n cap 21 as shown in FIG. 11 (NO in S3), the controller 500 checks whether the capping failure detection is performed for all of the caps 12 (S4). Controller 500 determines whether the capping failure detection is performed for all of the caps 12 by determining if n exceeds in, which is a total number of caps. If the capping failure detection is performed for all of the caps, (YES in S4), the controller 500 ends the capping failure detection for all the caps 21 (S7).

If there is a cap 21 that is not judged during the capping failure detection (NO in S4), the controller 500 increments n (S6) and performs the capping failure detection for number n+1 cap 21 counted in the direction from the conveyance belt 12 to the side plate 400B in FIG. 2. In the present disclosure, the capping failure detection is performed on the suction cap 21*a*, and if it is judged that the suction cap 21*a* normally caps the nozzle face 41, the capping failure detection is performed on the moisture keeping cap 21*b*. In this case, the controller 500 moves the carriage 3 to the position where all the caps 21*a* and 21*b* faces the corresponding heads 4*a* and 4*b*, respectively, and the suction cap 21*a* caps the head 4*a* and the moisture keeping cap 21*b* caps the head 4*b*, respectively.

In this condition such that all heads 4 has been capped by the caps 21, the controller 500 increases the drive voltage of the main scanning motor 15 until the carriage 3 moves and measures the limit drive voltage V2. Then, the controller 500 reads out the limit drive voltage V1, which is measured at the capping, failure detection of the suction cap 21*a*, measured just before the measurement of the limit drive voltage V2 and the drive voltage threshold value Vsn from the memory 501. The controller calculates the value of V2−V1 and checks whether the calculated V2−V1 is below the drive voltage threshold value Vsn.

If the calculated V2−V1 is below the drive voltage threshold value Vsn, the controller 500 judges that there is a capping failure in the moisture keeping cap 21*b* and thus the moisture keeping cap 21*b* is abnormal. On the other hand. If the calculated V2−V1 is equal to or greater than the drive voltage threshold value Vsn, the controller 500 judges that the moisture keeping cap 21*b* can normally cap the head 21*b* and thus the moisture keeping cap 21*b* is normal. That is, because there are two caps 21, the suction cap 21*a* and the moisture keeping cap 21*b*, all of the control flow of the capping failure detection will be ended when the capping failure detection of the moisture keeping cap 21*b* has ended.

The controller 500 measures the drive force of the main scanning motor 15 when the carriage 3 starts to move by gradually increasing the drive voltage of the main scanning, motor 15 to gradually increase the drive force of the main scanning motor 15. Then the controller 500 judges the capping failure based on whether the measured drive force is below the threshold value.

Therefore, controller 500 not only detects whether the cap 21 does not contact the nozzle face 41 of the head, but also detects the contact force between the cap 21 and the nozzle face 41 of the head 4 and determines whether the contact force is below the predetermined value. Thus, controller 500 detects the capping failure caused by reduced contact pressure between the caps 21 and the heads 4 because of worn out of the elastic part 84 of the caps 21, which happens even if the whole of top edge part of the elastic part 84 of the caps 21 normally contact the nozzle face 41 of the heads 4.

Therefore, controller 500 may notify a user before a gap is formed between the top edge part of the elastic, part 84 of the caps 21 and the nozzle face 41 of the heads 4 that prevents the caps 21 from keeping the moisture inside the nozzle 4*n* of the heads 4. Thus, it is possible to repair the liquid discharger 200 by exchanging the caps 21 before the caps 21 lost its ability to cap and seal the nozzle face 41 of the heads 4. Further, the controller 500 may detect the capping failure when moving the caps 21 until the position where the caps 21 contacts the nozzle face 41 of the head 4 without additional components such as a movement regulation part.

The controller 500 measures the drive force of the main scanning motor 15 when the carriage 3 starts to move by gradually increasing the drive voltage of the main scanning motor 15 to increase the drive force of the main scanning motor 15. Then, the controller 500 judges the capping failure based on whether the measured drive force is below the threshold value. Therefore, the controller 500 may detect the capping failure by using any types of configuration of the cap mover 700. This results in a greatly increased degree of freedom for designing the liquid discharger 200.

FIGS. 13A-13E illustrate a front view of a liquid discharger 200 and a capping failure detecting operation of a liquid discharger 200 having a plurality of heads 4 for each color. The liquid discharger 200 shown FIGS. 13A-13E includes four caps 21K, 21C, 21M, and 21Y for each color of the heads 4K, 4C, 4M, and 4Y.

Figure 13A:
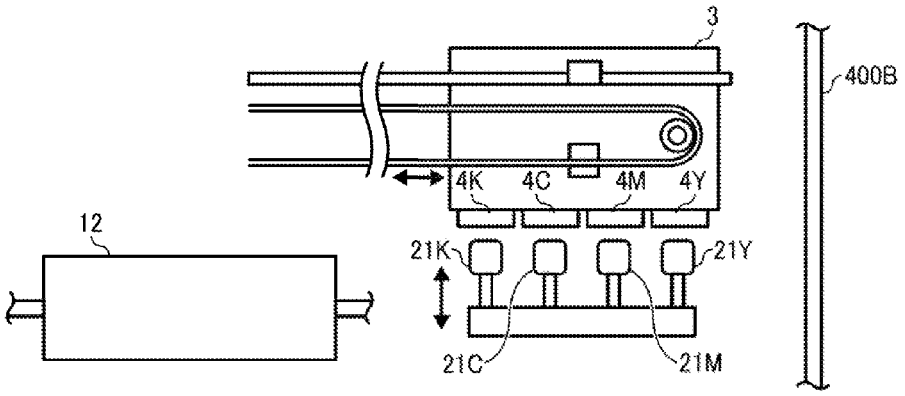
FIGS. 13A-13E illustrate a front view of a liquid discharger and a capping failure detecting operation of a liquid discharger having a plurality of heads for each color.
Figure 13B:
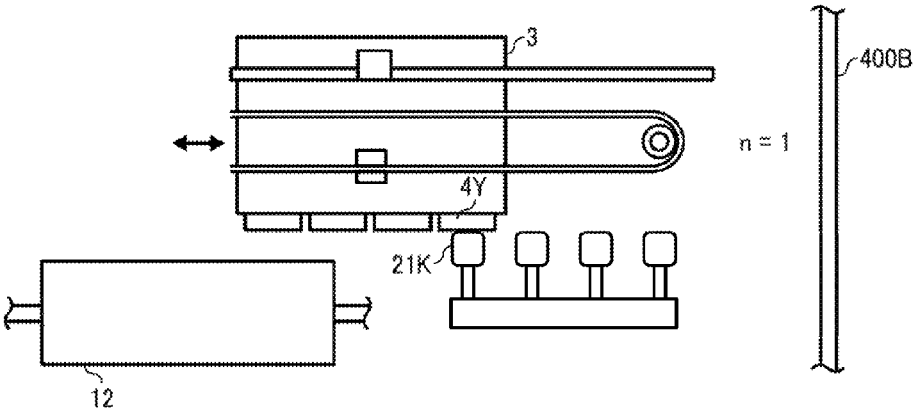

First, the controller 500 performs the capping failure detection operation for the cap 21K which is the first cap (n=1) counted from the direction from the conveyance belt 12 to the side plate 400B in FIGS. 13A and 13B.

The caps 21K, 21C, 21M, and 21Y are moved by the cap mover 700, as shown in FIG. 8. The controller 500 moves the carriage 3 and stops at the position where the head 4Y faces the cap 21K, as shown in FIG. 13B, by driving the main scanning motor 15. Then, the controller 500 drives the cap mover 700 and moves the cap 21K of the black color upward until the cap 21K contacts the nozzle face 41 of the head 4Y of the yellow color.

Next, the controller 500 gradually increases the drive voltage of the main scanning motor 15 and measures the limit drive voltage V1 when the carriage 3 starts to move. Then, the controller 500 judges whether the measured limit drive voltage V1 is below the drive voltage threshold value Vsn. If the measured limit drive voltage V1 is below the drive voltage threshold value Vsn, the controller 500 judges that there is a capping failure occurred on the cap 21K and notifies it to the user. On the other hand, if the measured limit drive voltage V1 is equal to or greater than the drive voltage threshold value Vsn, the controller 500 judges that the cap 21K normally caps the head 4Y.

Figure 13C:
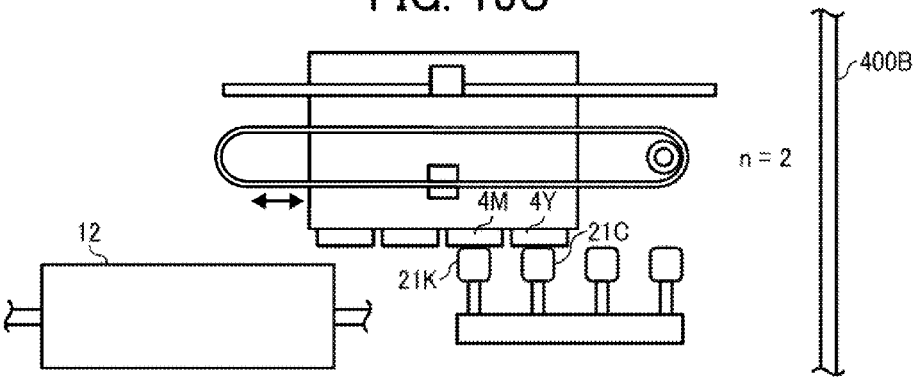

If the controller 500 judges that the cap 21K normally caps the head. 4Y, the controller 500 will perform the capping failure detection operation for the cap 21C, which is the second cap (n=2), counted from the direction from the conveyance belt 12 to the side plate 400B in FIG. 13C.

First, the controller 500 moves the carriage 3 and stops at the position where the head 4Y faces the cap 21C as shown in FIG. 13C by driving the main scanning motor 15. Then, the controller 500 drives the cap mover 700 and moves the cap 21K of black color, and the cap 21C of cyan color, upward until the cap 21*k* contacts the nozzle face 41 of the head 4M of magenta color, and the cap 21C contacts the nozzle face 41 of the head 4Y of yellow color.

Next, the controller 500 gradually increases the drive voltage of the main scanning motor 15 and measures the limit drive voltage V2 when the carriage 3 starts to move. Then, the controller 500 judges whether the measured limit drive voltage V2−V1 is below the drive voltage threshold value Vsn. If the measured limit drive voltage V2−V1 is below the drive voltage threshold value Vsn, the controller 500 judges that there is a capping failure occurred on the cap 21C and notifies it to the user. On the other hand, if the measured limit drive voltage V2−V1 is equal to or greater than the drive voltage threshold value VSN, the controller 500 judges that the cap 21C normally caps the head 4Y.

Figure 13D:
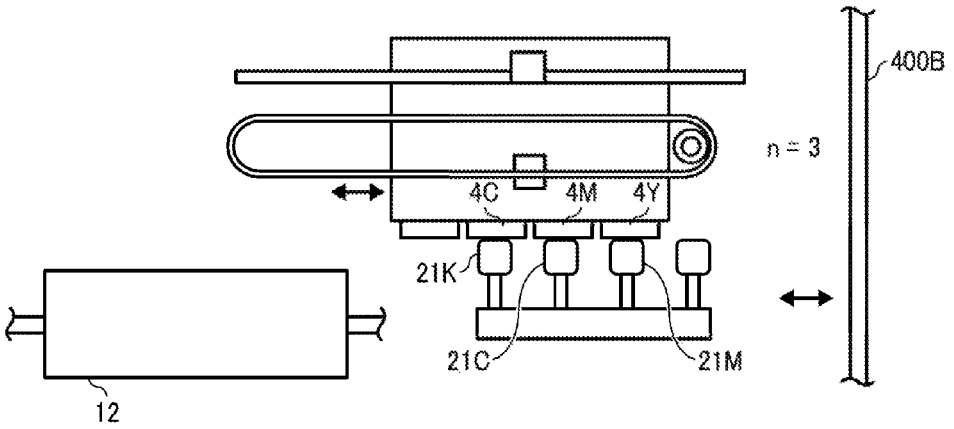

If the controller 500 judges that the cap 21C normally caps the head 4Y, the controller 500 will perform the capping failure detection operation for the cap 21M, which is the third cap (n=3), counted from the direction from the conveyance belt 12 to the side plate 400B in FIG. 13D.

First, the controller 500 moves the carriage 3 and stops the position where the head 4Y faces the cap 21M by driving the main scanning motor 15. Then, the controller 500 drive the cap mover 700 and moves the cap 21K of black color, the cap 21C of cyan color, and 21M of magenta color upward until the cap 21*k* contacts the nozzle face 41 of head 4C of cyan color, the cap 21C contacts the nozzle face 41 of the head 4M of magenta color, and the cap 21M contacts the nozzle face 41 of the head 4Y of yellow color.

Next, the controller 500 gradually increases the drive voltage of the main scanning motor 15 and measures the limit drive voltage V3 when the carriage 3 starts to move. Then, the controller 500 judges whether the measured limit drive voltage V3-V2 is below the drive voltage threshold value Vsn. If the measured limit drive voltage V3-V2 is below the drive voltage threshold value Vsn, the controller 500 judges that there is a capping failure occurred on the cap 21M and notifies it to the user. On the other hand, if the measured limit drive voltage V3-V2 is equal to or greater than the drive voltage threshold value Vsn, the controller 500 judges that the cap 21M normally caps the head 4Y.

Figure 13E:
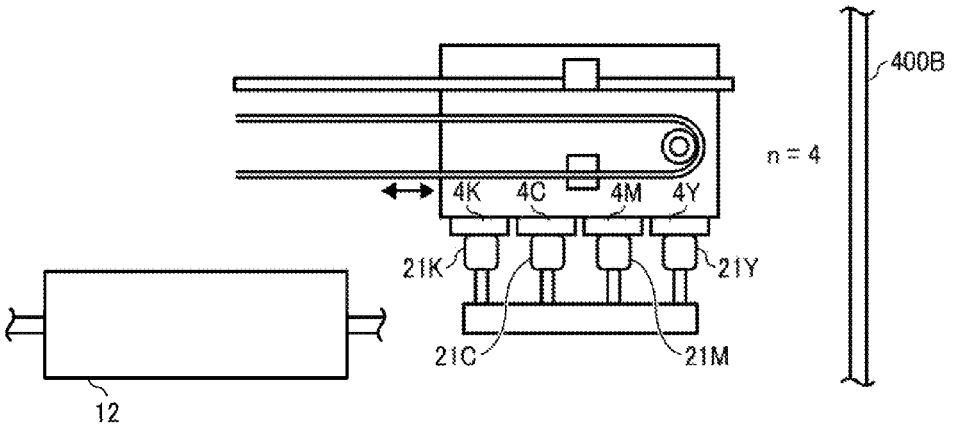

If the controller 500 judges that the cap 21M normally caps the head 4Y, the controller 500 will perform the capping failure detection operation for the cap 21Y, which is the fourth cap (n=4), counted from the direction from the conveyance belt 12 to the side plate 400B in FIG. 13E.

First, the controller 500 moves the carriage 3 and stops a t the position where the bead 4Y faces the cap 21Y by driving the main scanning motor 15. Then, the controller 500 drives the cap mover 700 and moves the cap 21K of black color, the cap 21C of cyan color, 21M of magenta color, and the cap 21Y of yellow color upward until the cap 21*k* contacts the nozzle face 41 of the head 4K of black color, the cap 21C contacts the nozzle face 41 of the head 4C of cyan color, the cap 21M contacts the nozzle face 41 of the head 4M of magenta color, and the cap 21Y contacts the nozzle tare 41 of the head 4Y of yellow.

Next, the controller 500 gradually increases the drive voltage of the main scanning motor 15 and measures the limit drive voltage V4 when the carriage 3 starts to move. Then, the controller 500 judges whether the measured limit drive voltage V4-V3 is below the drive voltage threshold value Vsn if the measured limit drive voltage V4-V3 is below the drive voltage threshold value Vsn, the controller 500 judges that there is a capping failure occurred on the cap 21Y and notifies it to the user. On the other hand, if the measured limit drive voltage V4-V3 is equal to or greater than the drive voltage threshold value Vsn, the controller 500 judges that the cap 21Y normally caps the head 4Y.

In this way, the controller judges whether all the caps 21K, 21C, 21M, 21Y normally cap, and are capable of normally capping, the heads 4K, 4C, 4M, and 4Y.

The liquid discharger 200 is configured to have a numbers of caps 21 equal to or more than three moved by one cap mover 700 vertically at the same time, as shown in FIG. 13. With such a configuration, it is difficult to independently move the central caps 21C and 21D to contact the nozzle face 41 of the heads 4. However, the controller 500 can detect the capping failure even if plurality of the caps 21 contacts the nozzle face 41 of the heads 4 by performing the capping failure detection as explained above.

Further, if the liquid discharger 200 has a configuration to have a suction cap 21K that can move independently from other caps 21C, 24M, and 21Y vertically as shown in FIGS. 14A-14E. FIGS. 14A-14E illustrate a front view of liquid discharger 200 and an operation of detecting a failure of mounting a head on carriage 3.

Figure 14A:
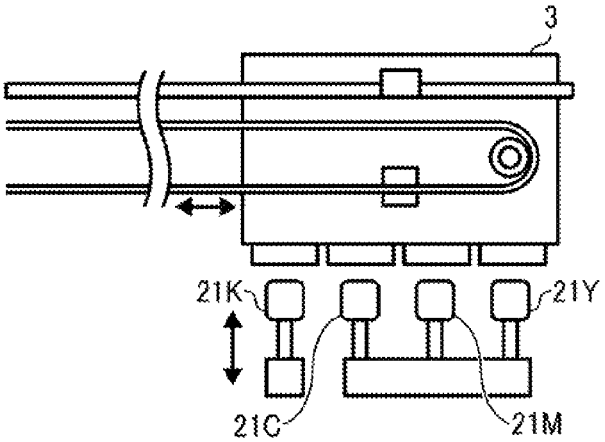
FIGS. 14A-14E illustrate as front view of a liquid discharger and an operation of detecting a failure of mounting a head on a carriage.
Figure 14B:
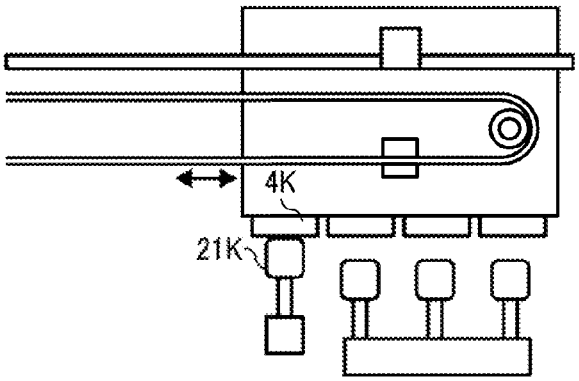

Specifically, the controller 500 moves the carriage 3 and stops at the position where the head 4K faces the cap 21K by driving the main scanning motor 15, as shown in FIG. 14B. Then, the controller 500 drives the cap mover 700 and moves the cap 21K upward until the cap 21K contacts the nozzle face 41 of the head 4K.

Then, the controller 500 gradually increases the drive voltage of the main scanning motor 15 and measures the limit drive voltage Vk at the time when the carriage 3 starts to move and stores the limit drive voltage Vk in the memory 501.

Figure 14C:
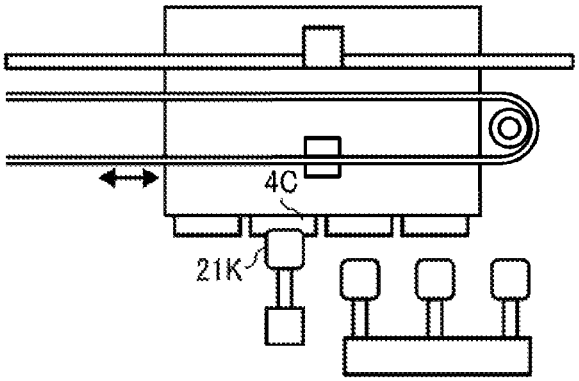

Next, the controller 500 moves the carriage 3 and stops at the position where the head 4C faces the cap 21K by driving the main scanning motor 15, as shown in FIG. 14C. Then, the controller 500 drives the cap mover 700 and moves the cap 21K upward until the cap 21K contacts the nozzle face 41 of the head 4C.

Then, the controller 500 gradually increases the drive voltage of the main scanning motor 15 and measures the limit drive voltage Vc at the time when the carriage 3 starts to move and stores the limit drive voltage Vc in the memory 501.

Figure 14D:
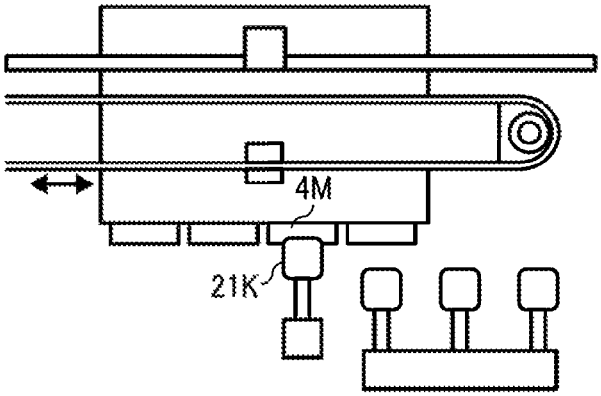

Next, the controller 500 moves the carriage 3 and stops at the position where the head 4M faces the cap 21K by driving the main scanning motor 15, as shown in FIG. 14D. Then, the controller 500 drives the cap mover 700 and moves the cap 21K upward until the cap 21K contacts the nozzle face 41 of the head 4M.

Then, the controller 500 gradually increases the drive voltage of the main scanning motor 15 and measures the limit drive voltage Vm at the time when the carriage 3 starts to move and stores the limit drive voltage Vm in the memory 501.

Figure 14E:
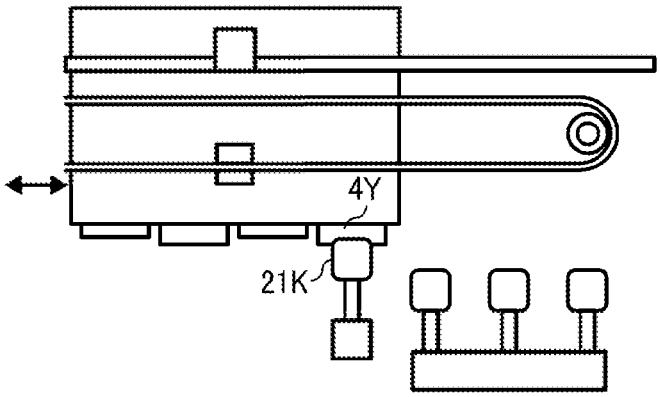

Next, the controller 500 moves the carriage 3 and stops at the position where the head 4Y faces the cap 21K by driving the main scanning motor 15, as shown in FIG. 14E. Then, the controller 500 drives the cap mover 700 and moves the cap 21K upward until the cap 21K contacts the nozzle face 41 of the head 4Y.

Then, the controller 500 gradually increases the drive voltage of the main scanning motor 15 and measures the limit drive voltage Vy at the time when the carriage 3 starts to move and stores the limit drive voltage Vy in the memory 501.

If the head 4 is not normally fixed the carriage 3, such as the head 4 is not fixed to the predetermined position or is not properly mounted on the carriage 3, the contact force between the cap 21 and head 4 is different from a predetermined contact force. Therefore, the static friction three between the cap 21 and the head 4, which is not normally fixed to the carriage 3, is different from a predetermined static friction force between the cap 21 and the head 4, which is normally fixed to the carriage 3. Thus, the measured drive force of the main scanning motor 15 is also different.

Further, the cap 21, which is in contact with each of the heads 4, is the suction cap 21K in FIGS. 14A-14E, the influence of a static friction force, which is caused by the suction cap 21K or the cap mover 700, is same for each of the heads 4K, 4C, 4M, and 4Y. Thereby, the difference among each of the measured four limit drive voltages Vk, Vc, Vm, and Vy are the difference caused by the failure of fixing the head 4 on the carriage 4. Thus, it is possible to detect the failure of fixing the head 4 on the carriage 4 by comparing the measured four limit drive voltage Vk, Vc, Vm, and Vy and finding out the limit drive voltage, which is clearly different from the other limit drive voltages.

Figure 15A:
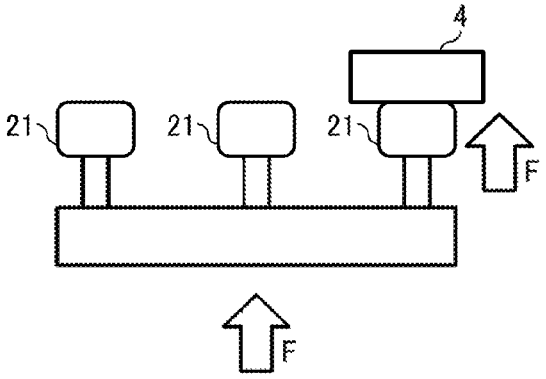
FIGS. 15A-15C illustrate a front view of a liquid discharger and to contact pressure of a cap against a head when a spring does not push the cap upward.
Figure 15B:
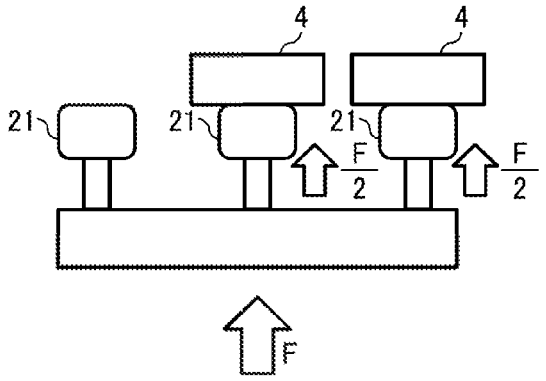
Figure 15C:
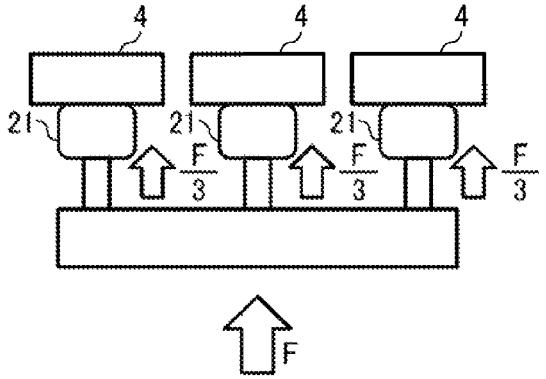

FIGS. 15A-15C illustrate a front view of a liquid discharger and a contact pressure of a cap against a head when a spring does not push the cap upward.

In FIGS. 15A-15C, the cap mover 700 moves three caps 21 vertically and does not have springs 152 for each of caps 21. Thus, the cap mover 700 has to push caps 21 to the heads 4 by driving a maintenance motor 502 and rotating a cam shaft 121 and a cap cam 122*a* in FIG. 8 without using springs 152.

As shown in FIG. 15A, when one of three caps 21 contacts the heads 4, the pressure force of the cap mover 700 that pushes cap 21 to the head 4 is applied only to one cap 21 that contacts the head 4, and the friction pressure between the cap 21 and head 4 is large. On the other hand, when two of three caps 21 contact the head 4 as shown in FIG. 15B, the pressure force of the cap mover 700 that pushes caps 21 to the heads 4 is distributed to two caps 21 that contact the head 4, and the friction pressure between the caps 21 and head 4s in FIG. 15B is smaller than the friction pressure in FIG. 15A.

Further, as shown in FIG. 15C, when all of three caps 21 contact the heads 4, the pressure force of the cap mover 700 that pushes cap 21 to the head 4 is distributed to all of the caps 21 that contacts the head 4, and the fiction pressure between the cap 21 and head 4 in FIG. 15C is smaller than the friction pressure in FIG. 15B.

When the cap mover 700 does not use springs to push caps 21 to the heads 4, the load applied to the heads 4 by the caps 21 is a force of the cap mover 700 that push the caps 21 to the heads 4 and a restoration force generated by the elastic, deformation of the elastic pan. 84 of the caps 21. Even if the number of caps 21 that contact the heads 4 is increased, the force of the cap mover 700 that pushes the caps 21 to the heads 4 does not increase.

Further, each cap 21 and each head 4 has a same structure, the static friction coefficient between each cap 21 and each head 4 are approximately the same. Thus, the factor that increases the static friction coefficient by the increase in the number of the caps 21 that contact heads 4 is a restoration force generated by the elastic deformation of the elastic part 84 of the caps 21. Therefore, the increase of the limit drive pressure by the increase in the number of caps 21 that caps the heads 4 is very small. As a result, it is difficult to detect the capping failure of the caps 21.

Figure 16A:
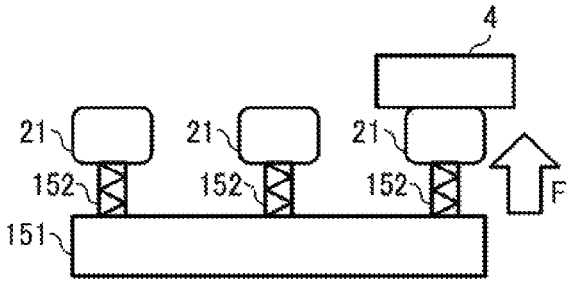
FIGS. 16A-16C illustrate a front view of a liquid discharger and a contact pressure of a cap against a head when as spring pushes the cap upward.
Figure 16B:
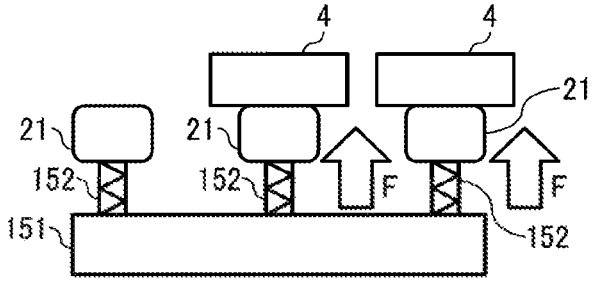
Figure 16C:
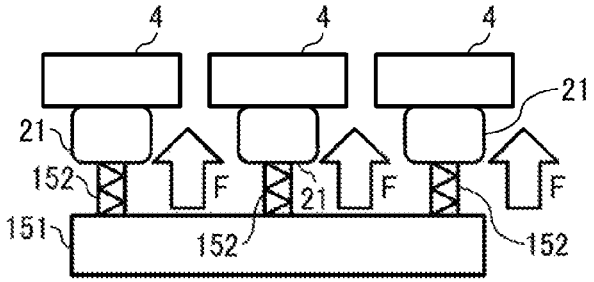

FIGS. 16A-16C illustrate as front view of a liquid discharger and a contact pressure of a cap against a head when a spring pushes the cap upward.

As illustrated in FIG. 16A, the caps 21 are held by the holder 151, and the springs 152 disposed to each of the caps 21 pushes the caps 21 upward. After the caps 21 contact the heads 4, the caps 21 move relatively downward toward the holder 151 while compressing the springs 152. As a result, the load applied to the heads 4 is a sum of the pushing force of the springs 152 and the restoration force generated by the elastic deformation of the elastic part 84 of the caps 21.

Further, each cap 21 has a same structure so that, when two caps 21 contact two heads 4, respectively, the pushing force of the springs 152 and the restoration force of the elastic part 84 of the caps 21 are applied to each of the two heads 4, as shown in FIG. 16B. Thus, the total load applied to the head 4 when two caps 21 contact two heads 4 as in FIG. 16B become twice of the total load applied to the head 4 when one cap 21 contact one head 4 as in FIG. 16A.

Therefore, if each of the caps 21 normally caps each of the heads 4, the static friction force when two caps 21 contact two heads 4 becomes twice of the static friction force when one cap 21 contacts one head 4. Thus, the limit drive voltage when two caps 21 contact two heads 4 becomes twice of the limit drive voltage when one cap 21 contact one head 4.

Further, when three caps 21 contact three heads 4 as shown in FIG. 16C, respectively, the pushing force of the springs 152 and the restoration force of the elastic pans 84 of the caps 21 are applied to each of the three heads 4. Thus, the total load applied to the head 4 when three caps 21 contact three heads 4 as in FIG. 16C become triple of the total load applied to the head 4 when one cap 21 contact one bead 4 as in FIG. 16A.

Therefore, the static friction force when three caps 21 contact three heads 4 become triple of the static friction force when one cap 21 contact one head 4, and thus the limit drive voltage when three caps 21 contact three heads 4 become triple of the limit drive voltage when one cap 21 contact one head 4.

In this way, if a number of caps 21 that contact the heads 4 increases, the static friction force also greatly increases, and the limit drive voltage for moving the carriage 3 also greatly increases. Therefore, the difference between of the limit drive voltage when the capping failure has been occurred and the limit drive voltage when the caps 21 normally contact the heads 4 become large. Thus, it is possible to sensitively detect the capping failure.

Further, if the suction cap 21*a* cannot properly cap the head 4 during the suction operation, air is sucked into the cap 21*a* through the gap formed between the cap 21*a* and the nozzle face 41 of the head 4 while driving the suction pump 27. Thus, the suction pump 27 and cap 21*a* cannot suck liquid inside the head 4. Therefore, the capping failure detection of the suction cap 21*a* may be performed before performing the suction operation.

Figure 17:
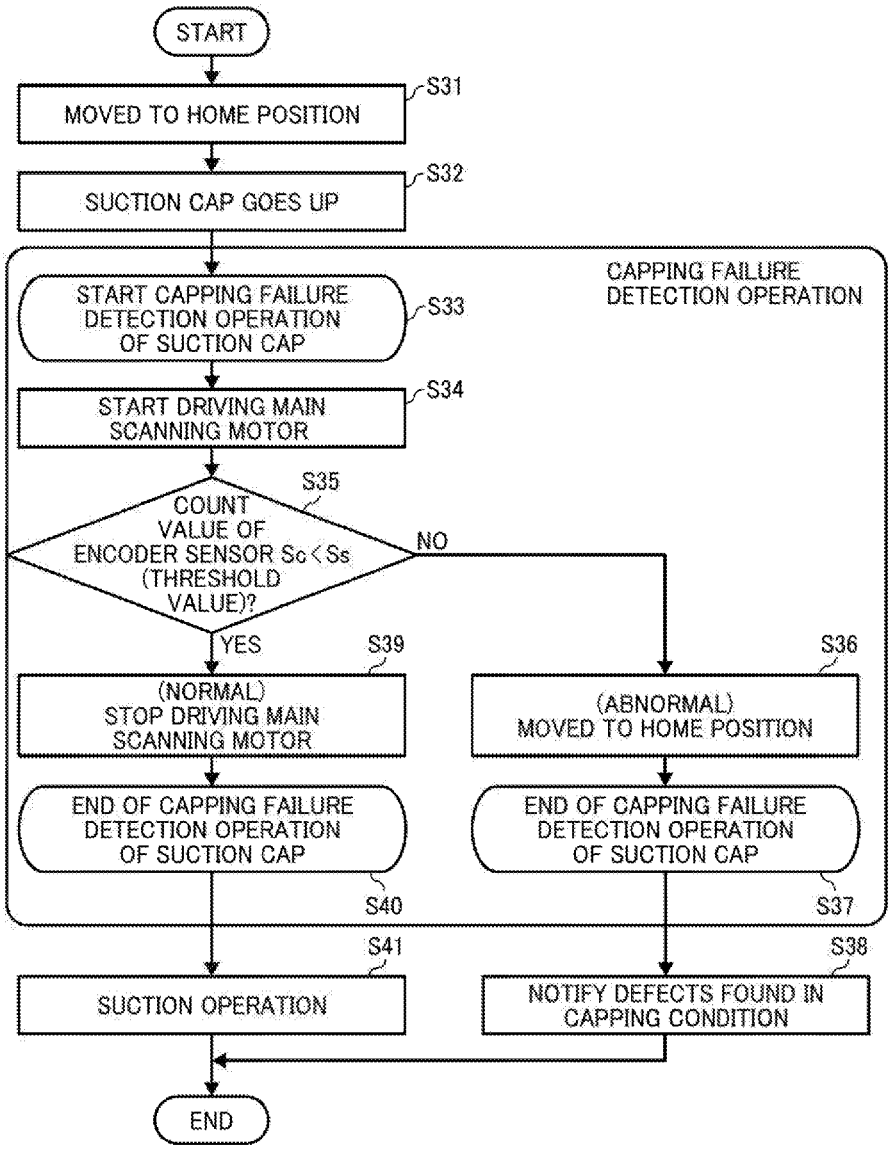
FIG. 17 is a flow chart illustrating an exemplary sucking operation including a capping failure detection operation performed by controller 500.

FIG. 17 is a flow chart illustrating an exemplary of sucking operation including a capping failure detection operation performed by controller 500. To begin, when the performing, the cleaning mode is instructed by the user, the controller 500 moves the carriage 3 to the home position (S31), and controller 500 moves the suction cap 21*a* upward to the position where the suction cap 21*a* contacts the head 4 (S32). The controller 500 starts the capping failure detection operation when the suction cap 21*a* moves to the position where the suction cap 21*a* contacts the nozzle face 41 of the head 4 (S33) and starts driving the main scanning motor 15 (S34). At this time the controller 500 applies a drive voltage lower than the drive voltage threshold value Vsn as explained above.

Next, the controller 500 detects an output signal from the encoder sensor 124*a* of the linear encoder 124 and judges whether the carriage has moved based or the output signal from the encoder sensor 124*a* (S35). In an exemplary implementation, the controller 500 reads out the encoder count threshold value Ss from the memory 501. Further, the controller 500 counts the output signal of the encoder sensor 124*a* and judges whether a carriage movement amount, which is a count value of the counted output signal, is equal to or greater than the encoder count threshold value Ss.

Because the drive voltage applied on the main scanning motor 15 is lower than the drive voltage threshold value Vsn, the drive force of the main scanning motor 15 is smaller than the static friction force between the suction cap 21*a* and the heads 4 when the suction cap 21*a* properly caps the nozzle face 41 of the head 4. Therefore, carriage 3 does not move. If the carriage movement amount Sc is below the encoder count threshold value Ss (YES in S35), and the controller 500 does not detect the movement of the carriage 3, controller 500 determines that the suction cap 21*a* normally caps the head 4.

Therefore, it is possible to properly suck the liquid inside the nozzles 4*n* of the head 4 when the controller 500 drives the suction pump 27 and generate a negative pressure inside the suction cap 21*a* while the suction cap 21*a* caps the nozzle face 41 of the head 4. Thus, when the controller 500 judges that the suction cap 21*a* normally caps the nozzle face 41 of the head 4, the controller 500 drives the suction pump 27 and performs the suction operation that sucks liquid from the nozzles 4*n* of the head 4 together with air or dust attached on the nozzles 4*n* (S39-S41).

If the carriage movement amount Sc is equal to or above the encoder count threshold value Ss (NO in S35) and the controller 500 detects that the carriage has moved, the controller 500 judges that the capping failure has occurred in the suction cap 21*a*. Then, the controller 500 does not perform the suction operation of the suction pump 27 and controller 500 moves the carriage 3 to the home position and indicates on the indicator 503 to notify the user that the capping failure has occurred (S36-S38).

Further, it is possible to determine whether the capping failure is occurred because of the capping failure of the suction cap 21*a* or because of the other factors by performing the capping failure detection operation of the suction cap 21*a* when the suction operation is not normally performed.

Figure 18A:
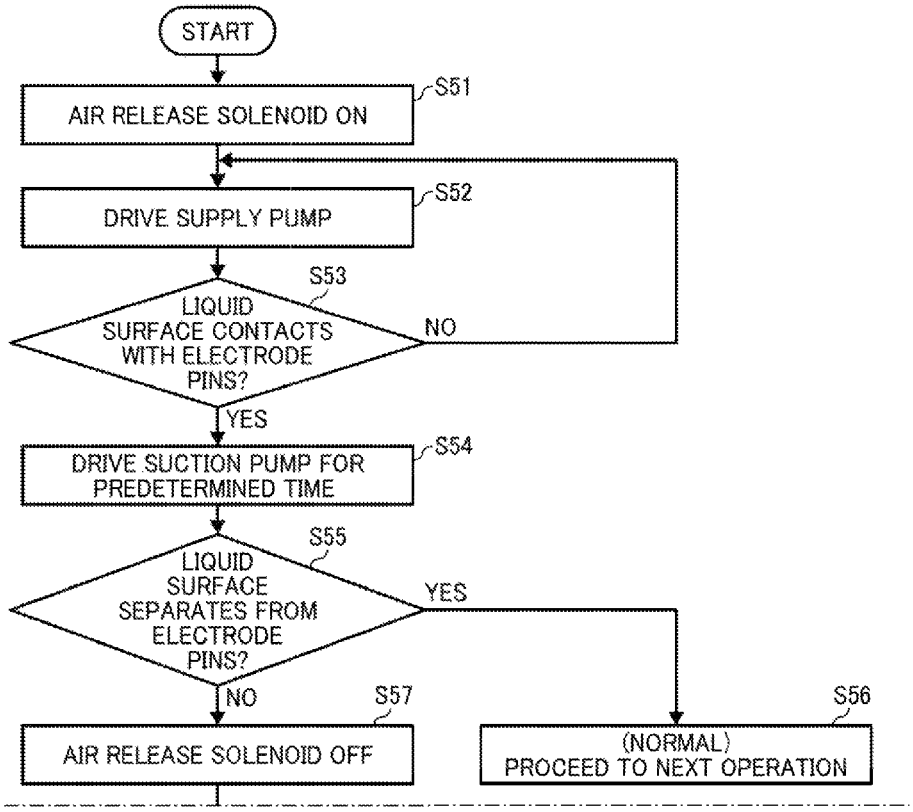
FIGS. 18A and 18B illustrate a flow chart of an example of liquid supply operation.
Figure 18B:
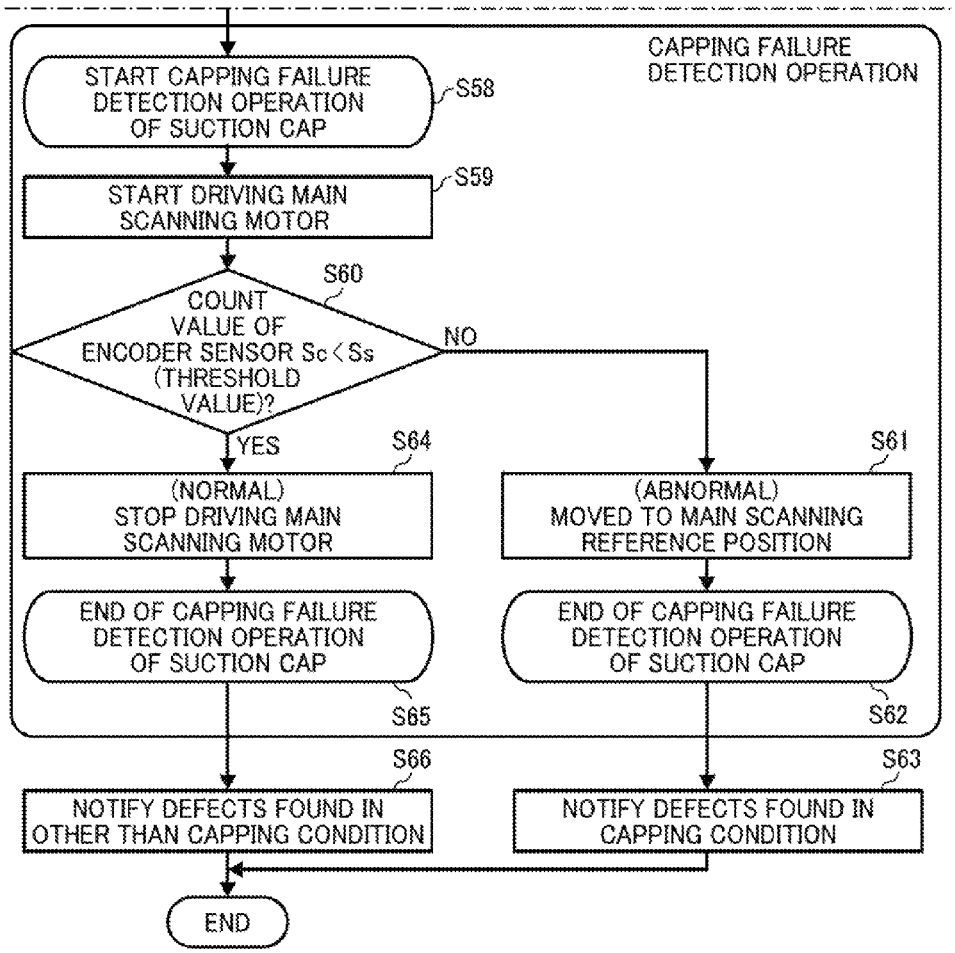

FIGS. 18A and 18B illustrate a flow chart of an example of liquid supply operation. First, the controller 500 turns on the as release solenoid 302 to release the air inside the head tank 5 to the atmosphere (S51). Then, the film 203 deforms outward, and liquid surface level inside the head tank 5 sank down and separates from the electrode pins 208*a* and 208*b*. Next, the controller 500 drives the supply pump 54 and supplies liquid from the liquid cartridge 50 to the head tank 5 (S52).

Then, if the electrode pins 208*a* and 208*b* detects the liquid surface by rising of liquid surface level inside the head tank 5 (YES in S53), the controller 500 steps driving the supply pump 54 and starts the suction operation (S54) by driving the cap mover 700 and the suction pump 27. That is, the controller 500 drives cap mover 700 to move the suction cap 21*a* upward to contact the nozzle face 41 of the head 4 and drives the suction pump 27 for a predetermined time to suck liquid inside the nozzles 4*n* of the head 4.

If the controller 500 drives the suction cap 27 and sucks liquid inside the nozzles 4*n* of the head 4, the liquid surface level inside the bead tank 4 sinks down, and as surface of the liquid will separate from the electrode pins 208*a* and 208*b*. However, if the liquid surface does not separate from the electrode pins 208*a* and 208*b*, there is as possibility that the capping failure between the suction cap 21*a* and the nozzle face 41 of the head 4 has occurred, or malfunction of the suction pump 27 has occurred, or any other various reasons.

Thus, when the liquid surface does not separate from the electrode pins 208*a* and 208*b* even if the controller 500 drives the suction pump 27 for a predetermined time (NO in S55), the controller 500 turns off the air release solenoid 302 and performs the capping failure detection operation of the suction cap 21*a* (S57 and S58), as explained with reference to FIG. 17. When the controller 500 detects that the carriage has moved, which is determined based on whether the carriage movement amount Sc is equal to or above the encoder count threshold value Ss (NO in S60), the controller 500 judges that the capping failure of the suction cap 21*a* has occurred. Then, the controller 500 moves the carriage 3 to the home position (S61), ends the capping failure detection operation (S62), and indicates on the indicator 503 to notify the user that the capping failure has occurred (S63).

On the other hand, if the carriage has not moved 8YES in S60) the suction cap 21*a* normally caps the head 4, the defects in suction operation is caused by the other factors. Thus, the controller 500 stops driving the main scanning motor 15 (S64), ends the capping failure detection operation (S65), the controller 500 notify the user that defects in suction operation is occurred because of other factors other than the capping failure (S66).

Figure 19:
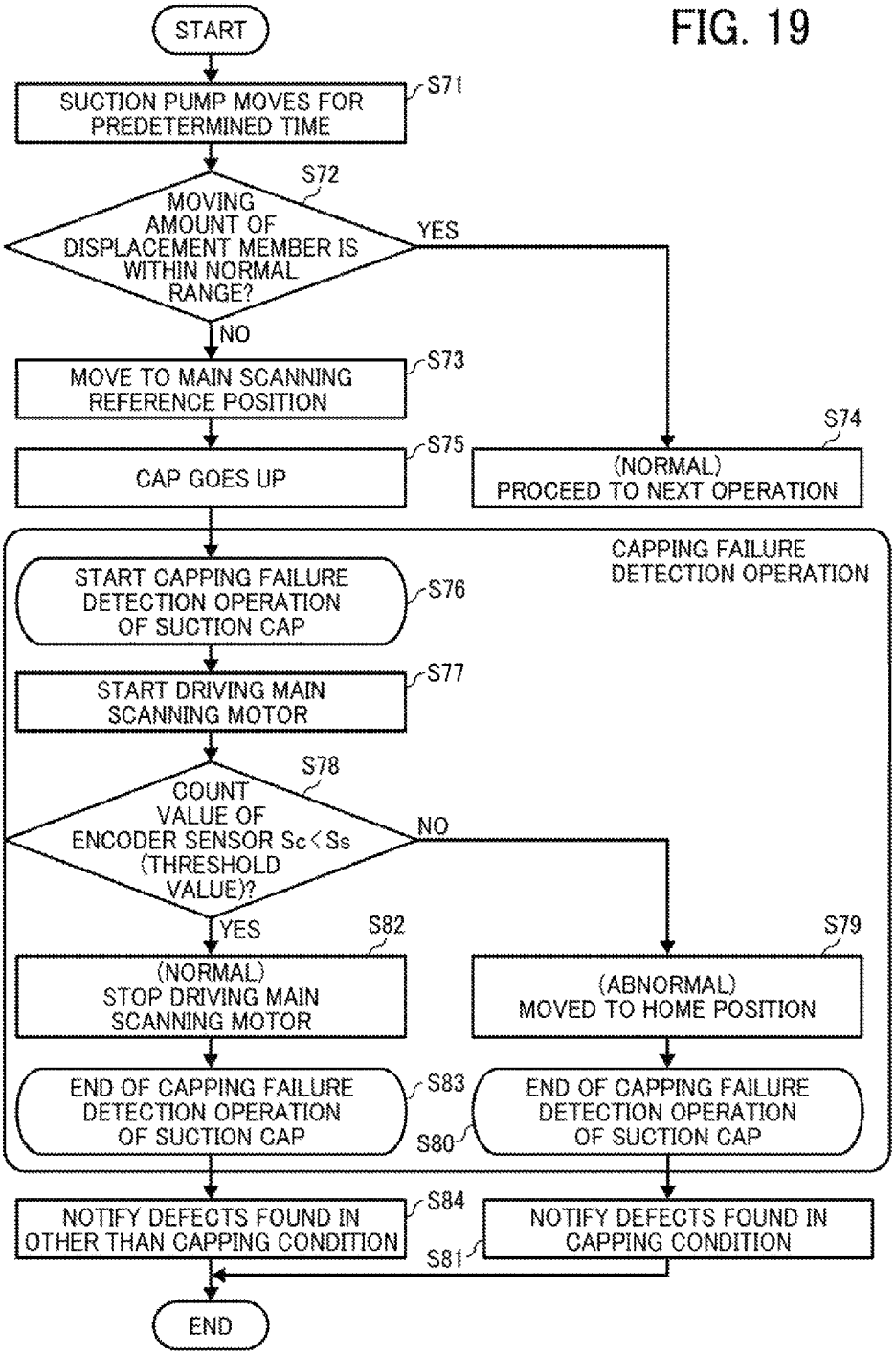
FIG. 19 is a flow chart illustrating another exemplary sucking operation.

FIG. 19 is a flow chart illustrating another exemplary sucking operation.

First, the controller 500 drives cap mover 700 to move the suction cap 21*a* upward to contact the nozzle face 41 of the bead 4 and drives the suction pump 27 for a predetermined time to suck liquid inside the nozzles 4*n* of the head 4 (S71).

If the controller 500 drives the suction cap 27 and sucks liquid inside the nozzles 4*n* of the head 4, the negative pressure inside the head tank 5 increases, and the film 203 deforms inward, and the displacing member 205 displaces inward. After the end of the suction operation, the suction cap 21*a* separates from the nozzle face 41 of the head 4. And the negative pressure between the suction cap 21*a* and the nozzle face 41 of the head 4 is released. Then, the film 203 deforms outward and the displacing member 205 displaces outward.

In this way, when the suction operation is performed, the displacing member 205 displaces for a predetermined range. At this time, when an amount of the displacement of the displacing member 205 is small, there is possibility that the suction operation is not performed normally. Thus, the controller watches the amount of displacement of the displacement member 205 by the feeler sensor 301, and if the amount of displacement of the displacement member 205 is within a predetermined normal range (NO in S72), the controller 500 performs the capping failure detection operation of the suction cap 21*a* and examines whether the suction failure is caused by the capping failure of the suction cap 21*a*. Controller 500 begins the failure detection option (S76) and starts driving main scanning motor 15 (S77). When the controller 500 determines that the carriage has moved, based on whether the carriage movement amount Sc is equal to or above the encoder count, threshold value Ss (NO in S78), the controller 500 judges that the capping failure of the suction cap 21*a* has occurred. Then, the controller 500 moves the carriage 3 to the home position (S79), ends the capping failure detection operation (S80), and indicates on the indicator 503 to notify the user that the capping failure has occurred (S81).

On the other hand, if the controller 500 determines that carriage has not moved (YES in S78), the suction cap 21*a* normally caps the head 4, and controller 500 determines that the defects in suction operation are caused by other factors. Thus, the controller 500 stops driving, the main scanning motor 15 (S82), ends the capping failure detection operation (S83), and the controller 500 notifies the user that defects in suction operation occurred because of factors other than the capping failure (S84).

In accordance with the present disclosure, the liquid discharger 200 may further include a carriage detector such as linear encoder 124 to detect a movement of the carriage 3. When liquid discharger 200 includes linear encoder 124, the controller 500 may be configured to judge that the capping failure has occurred when the measured drive force of the driver, such as the main scanning motor 15, is below a threshold value, such as drive voltage threshold value Vsn, when the carriage detector (linear encoder 124) detects the movement of the carriage 3.

This liquid discharger 200 detects whether the carriage 3 has moved by using carriage detector, such as the linear encoder 124 to detect the movement of the carriage 3. Therefore, the liquid discharger 200 can detect the drive force of the driver, such as the main scanning motor 15 when the carriage 3 has moved. Further, the friction force between the cap 21 and the nozzle face 41 of the head 4 is below the threshold value, such as the drive voltage threshold value Vsn, when the capping failure occurs. Thus, the liquid discharger 200 can detect the capping failure.

Liquid discharger 200 can judge the capping failure by judging whether the friction force between the cap 21 and the nozzle face 41 of the head 4 is below the threshold value, such as the drive voltage threshold value Vsn.

Further, the cap 21 may contact the nozzle face 41 of the head 4 to seal the nozzle 4*n*. Thus, the liquid discharger 200 can seal the nozzle 4*n* of the head 4 with a simple configuration.

In accordance with the present disclosure, the carriage 3 may mount a plurality of the heads 4 thereon, and a plurality of the caps 21 may be provided for each of the heads 4. The cap mover 700 moves the plurality of caps 21 at the same time, and the controller 500 judges whether the failure of capping has been occurred based on a difference of a first driving force Vn and a second driving force Vn−1.

The first driving force Vn of the main scanning motor 15 is detected when the carriage 3 start to move in the main scanning, direction by driving the cap mover 700 while the cap 21 is moved to the capping position where to numbers (n is equal to or greater than 2) of the heads 4 faces the caps 21 and the second driving force Vn−1 is detected when the carriage 3 start to move in the main scanning direction by driving the cap mover 700 while the cap 21 is moved to the capping position where n−1 numbers of the heads 4 faces the caps 21.

As described above, if the cap mover 700 moves plurality of caps 21 at the same time between the capping position and the evacuation position, there is a possibility that the controller 500 cannot judge the capping failure by individually moving the cap 21 to contact the nozzle face 41 of the head 4.

Therefore, first, the caps 21 cap the nozzles 4*n* of n numbers of the head 4, and in this condition, the drive force Vn at the time when the carriage 3 start to move is measured. The drive force at this time is usually greater than the static friction force between the n numbers of caps 21 and the n numbers of corresponding heads 4. Usually, each of configurations of the heads 4 and each of configurations of the caps 21 are same, and thus the static friction coefficients between each of the heads 4 and caps 21 are same, and the static friction coefficient between each of the caps 21 and the heads 4 are same.

Thus, when the caps 21 properly contact the nozzle face 41 of the head 4 and properly seals the nozzles 4*n*, the loads applied to each of the heads 4 are the same. Therefore, when the nozzles 4*n* of the heads 4 is properly sealed by the caps 21, the static friction force between each of the caps 21 and the nozzle face 41 of the heads 4 are the same. Therefore, the drive force necessary for move the carriage 3 against the static friction force when the nozzles 4*n* are properly sealed become static friction force multiply n.

Accordingly, the static friction force between the caps 21, which is added when measuring the above drive force Vn, and the heads 4 can be calculated by deducting a drive force Vn−1 from the above described Vn. The drive force Vn−1 is measured at the time the carriage 3 start to move by driving the main scanning motor 15 after capping nozzles 4*n* of n−1 numbers of the heads 4 with the caps 21 by driving the cap mover 700. In this way, it is possible to judge the capping failure for each cap 21 even if each of the caps 21 cannot contact the heads 4 individually.

In accordance with the present disclosure, the liquid discharger 200 may further include a pusher, such as spring 152, to push the cap 21 against the nozzle face 41 of the head 4. In this way, as explained in FIGS. 15A-15C and 16A-16C, when the caps 21 contact the nozzle face 41, the load can become a pushing force of the spring 152. The spring 152 can greatly increase the static friction force when the numbers of the caps 21, which contact nozzle face 41 of the heads 4, increases compared to the configuration that does not have the spring 152. Thereby, it is possible to sensitively judge the sealing condition by increase the difference between the above explained it and above explained Vn−1.

In accordance with the present disclosure, the liquid discharger 200 has the carriage 3 mounts a plurality of heads 4 thereon. The liquid discharger 200 has a plurality of the caps 21 to a each of the heads 4, respectively. The cap mover 700 moves one of the plurality of caps 21 between the capping position and the evacuation position independently. The controller 500 judges whether a failure of fixing the head on the carriage 3 has been occurred based on a plurality of measured drive force, which are measured for each of the plurality of the heads 4 when the main scanning motor 15 moves the carriage 3 in the main scanning direction after the cap mover 700 moves one of the 21, which can move independently, toward the capping position.

As explained with reference to FIGS. 14A-14E, the contact pressure between the heads 4 and the caps are different between the heads 4, which are not fixed to the carriage 3 at regular position or loosely fixed to the carriage 3, and the heads 4 which are normally fixed to the carriage 3. As a result, the static friction force between the caps 21 and the heads 4 having fixing failure is different from the static friction force between, the caps 21 the heads 4 that does not have fixing failure. Thus, the drive force at the time when the carriage 3 start to move while the nozzles 4*n* of the heads 4 are sealed by the caps 21 are different between the heads 4 having fixing failure and the heads 4 that does not have fixing failure.

Further, the caps 21 that contact the nozzle face 41 of the heads 4 during measuring the drive force are common, there is no changes in contact pressure, which is caused by caps 21 or cap mover 700. Thus, by comparing a plurality of drive force measured for each of the heads 4 and by finding the drive force, which is greatly different from the other drive force, the controller can find that the heads 4, which corresponds to this drive force greatly different from the other drive force, have fixing failure. Therefore, it possible to detect fixing failure of the head 4 on the carriage 3.

In this way, the controller 500 can detect the fixing failure of the heads 4, it is possible to perform the proper service, such as exchanging the heads 4 having fixing failure, on the liquid discharger 200 by notifying the detected fixing failure of the heads 4 to the user.

In accordance with the present disclosure, the controller 500 may control the cap mover 700 to move the cap 21 to capping position and gradually increase the drive force of the main scanning motor 15 to move the carriage 3 in the main scanning direction. Thereby, the controller 500 can measure the drive force when the carriage 3 starts to move.

The above descriptions of a liquid discharger, capping failure detection operation and fault detection method are examples and various modifications, replacements, or combinations can be made without departing from, the scope of the present disclosure by persons skilled in the art. Moreover, additional modifications and variations of the present disclosure are possible in light of the above teachings.

What is claimed is:

1. A liquid discharger, comprising:

a head including a nozzle face and a nozzle that discharges liquid droplets, the nozzle formed on the nozzle face;

a carriage that mounts the head and moves the head in a main scanning direction;

a driver that moves the carriage in the main scanning direction;

a cap that contacts and covers the nozzle face;

a cap mover that moves the cap between a capping position, in which the cap contacts the nozzle face, and an evacuation position, in which the cap is separated from the nozzle face; and processing circuitry configured to measure a driving force of the driver, and judge whether a capping failure has occurred based on the driving force.

2. The liquid discharger as claimed in claim 1, further comprising:

a carriage detector that detects a movement of the carriage, wherein the processing circuitry judges that the capping failure has occurred when the measured driving force is below a threshold value and the carriage detector detects the movement of the carriage.

3. The liquid discharger as claimed in claim 1, wherein the cap contacts the nozzle face to seal the nozzle.

4. The liquid discharger as claimed in claim 1, further comprising a pusher to push the cap against the nozzle face.

5. The liquid discharger as claimed in claim 1, further comprising:

a plurality of heads including the head; and a plurality of caps including the cap, each cap of the plurality of caps configured to cap a different respective head of the plurality of heads, wherein the carriage mounts the plurality of heads, the cap mover moves one cap of the plurality of caps between the capping position and the evacuation position independently, the processing circuitry judges whether a failure of fixing the head on the carriage has occurred based on a plurality of detected drive force, and the plurality of detected drive force is measured for the plurality of the heads when the carriage starts to move in the main scanning direction after the cap mover moves the one cap to the capping position.

6. The liquid discharger as claimed in claim 1, wherein the processing circuitry controls the driver to move the cap to the capping position and to gradually increase the driving force of the driver.

* * * * *